US010388228B2

(12) United States Patent
Kim et al.

(10) Patent No.: US 10,388,228 B2
(45) Date of Patent: Aug. 20, 2019

(54) DISPLAY DEVICE

(71) Applicant: SAMSUNG DISPLAY CO., LTD., Yongin-si, Gyeonggi-do (KR)

(72) Inventors: Yang Wan Kim, Yongin-si (KR); Seung Kyu Lee, Yongin-si (KR); Sun Ja Kwon, Yongin-si (KR); Tae Hoon Kwon, Yongin-si (KR); Byung Sun Kim, Yongin-si (KR); Hyun Ae Park, Yongin-si (KR); Su Jin Lee, Yongin-si (KR); Jae Yong Lee, Yongin-si (KR); Seung Ji Cha, Yongin-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 0 days.

(21) Appl. No.: 15/453,093

(22) Filed: Mar. 8, 2017

(65) Prior Publication Data

US 2017/0337877 A1 Nov. 23, 2017

(30) Foreign Application Priority Data

May 19, 2016 (KR) ..... 10-2016-0061607

(51) Int. Cl.
*G09G 3/32* (2016.01)
*G09G 3/3266* (2016.01)
(Continued)

(52) U.S. Cl.
CPC ..... *G09G 3/3266* (2013.01); *G09G 3/3225* (2013.01); *G09G 3/3233* (2013.01);
(Continued)

(58) Field of Classification Search
CPC ..... G09G 3/3266; G09G 3/322; G09G 2310/0281–0286; G09G 2300/0423
See application file for complete search history.

(56) References Cited

U.S. PATENT DOCUMENTS 7,365,714 B2 4/2008 Yoo
2005/0285824 A1* 12/2005 Shin ..... G09G 3/325 345/76

(Continued)

FOREIGN PATENT DOCUMENTS

EP 2927901 A2 7/2015
EP 3345180 A1 7/2018
KR 10-0476368 B1 3/2005

OTHER PUBLICATIONS

European Search Report dated Aug. 21, 2017 with respect to the European Patent Application No. 17172064.2.

(Continued)

*Primary Examiner* — Liliana Cerullo
(74) *Attorney, Agent, or Firm* — Lee & Morse, P.C.

(57) ABSTRACT

A display device includes a substrate, first pixels, second pixels, and third pixels. The substrate has a first pixel area, a second pixel area, and a third pixel area. The first pixels are in the first pixel area and are connected to first scan lines and first emission control lines. The second pixels are in the second pixel area and are connected to second scan lines and second emission control lines. The third pixels are in the third pixel area and are connected to third scan lines and third emission control lines. The second scan lines are spaced apart from the third scan lines, and the second emission control lines are spaced apart from the third emission control lines.

34 Claims, 21 Drawing Sheets

(51) Int. Cl.
*G09G 3/3225* (2016.01)
*G09G 3/3233* (2016.01)

(52) U.S. Cl.
CPC ..... *G09G 2300/0426* (2013.01); *G09G 2300/0842* (2013.01); *G09G 2300/0861* (2013.01); *G09G 2310/0202* (2013.01); *G09G 2310/0221* (2013.01); *G09G 2310/0251* (2013.01); *G09G 2310/0262* (2013.01); *G09G 2310/0281* (2013.01); *G09G 2310/0286* (2013.01); *G09G 2310/08* (2013.01)

(56) References Cited

U.S. PATENT DOCUMENTS

2010/0141570 A1 6/2010 Horiuchi et al.
2012/0105396 A1 5/2012 Sakamoto et al.
2012/0212517 A1 8/2012 Ahn
2013/0069854 A1 3/2013 Park et al.
2016/0019856 A1 1/2016 Tanaka et al.
2016/0111040 A1* 4/2016 Kim ..... G02F 1/13454 345/698
2018/0190190 A1* 7/2018 Xi ..... G09G 3/3225
2018/0204889 A1* 7/2018 Yu ..... G09G 3/3233

OTHER PUBLICATIONS

Extended European Search Report was issued from the European Patent Office dated Dec. 15, 2017 with respect to the European Patent Application No. 17172064.2.
European Search Report dated Jan. 8, 2019.

* cited by examiner

DISPLAY DEVICE

CROSS-REFERENCE TO RELATED APPLICATION

Korean Patent Application No. 10-2016-0061607, filed on May 19, 2016, and entitled: "Display Device," is incorporated by reference herein in its entirety.

BACKGROUND

1. Field

One or more embodiments described herein relate to a display device.

2. Description of the Related Art

An organic light emitting display device has an organic light emitting layer between two electrodes. Electrons injected from one electrode and holes injected from the other electrode combine in the organic light-emitting layer to form excitons. Light is emitted when the excitons change to a stable state.

The pixels of an organic light emitting display device are therefore self-emitting elements. The elements are driven to emit light based on signals, for example, from a scan driver, an emission driver, and a data driver. The drivers are mounted without concern for space efficiency. Therefore, the amount of dead space is significant.

SUMMARY

In accordance with one or more embodiments, a display device includes a substrate including a first pixel area, a second pixel area, and a third pixel area; first pixels in the first pixel area connected to first scan lines and first emission control lines; second pixels in the second pixel area connected to second scan lines and second emission control lines; and third pixels in the third pixel area connected to third scan lines and third emission control lines, wherein the second scan lines are spaced apart from the third scan lines and wherein the second emission control lines are spaced apart from the third emission control lines.

Each of the second pixel area and the third pixel area may be smaller than the first pixel area. The second pixel area may be spaced apart from the third pixel area. The substrate may include a first peripheral area, a second peripheral area, and a third peripheral area outside the first pixel area, the second pixel area, and the third pixel area.

The display device may include a first scan driver, in the first peripheral area, to supply a first scan signal to the first scan lines; a first emission driver, in the first peripheral area, to supply a first emission control signal to the first emission control lines; a second scan driver, in the second peripheral area, to supply a second scan signal to the second scan lines; a second emission driver, in the second peripheral area, to supply a second emission control signal to the second emission control lines; a third scan driver, in the third peripheral area, to supply a third scan signal to the third scan lines; and a third emission driver, in the third peripheral area, to supply a third emission control signal to the third emission control lines.

The second scan driver and the second emission driver may be at a first side of the second pixel area, and the third scan driver and the third emission driver may be arranged at a second side of the third pixel area. The second scan driver may be at a first side of the second pixel area, the second emission driver may be at a second side of the second pixel area, the third scan driver may be at a first side of the third pixel area, and the third emission driver may be at a second side of the third pixel area.

The first scan driver may include a first sub scan driver connected to a first side of the first scan lines; and a second sub scan driver connected to a second side of the second scan lines. The first sub scan driver and the second sub scan driver may concurrently supply the first scan signal to a same scan line. The first sub scan driver may be connected to a first side of the first scan lines, the first sub scan driver including a plurality of scan stage circuits to supply a first scan signal to the first scan lines, and the second sub scan driver may be connected to a second side of the first scan lines, the second sub scan driver including a plurality of scan stage circuits to supply the first scan signal to the first scan lines.

The first scan driver may include a first sub scan driver at a first side of the first pixel area; and a second sub scan driver at a second side of the first pixel area. The first sub scan driver may supply the first scan signal to a first portion of the first scan lines, and the second sub scan driver may supply the first scan signal to a second portion of the first scan lines.

The first sub scan driver may include a plurality of scan stage circuits to supply the first scan signal to the first portion of the first scan lines, and the second sub scan driver may include a plurality of scan stage circuits to supply the first scan signal to the second portion of the first scan lines. The scan stage circuits of the first sub scan driver may supply the first scan signal to an odd-number-th first scan lines, and the scan stage circuits of the second sub scan driver may supply the first scan signal to an even-number-th first scan lines.

The first emission driver may include a first sub emission driver connected to a first side of the first emission control lines; and a second sub emission driver connected to a second side of the second emission control lines. The first sub emission driver and the second sub emission driver may concurrently supply the first emission control signal for a same emission control line.

The first sub emission driver may be connected to a first side of the first emission control lines, the first sub emission driver including a plurality of emission stage circuits to supply the first emission control signal to the first emission control lines, and the second sub emission driver may be connected to a second side of the first emission control lines, the second sub emission driver including a plurality of emission stage circuits to supply the first emission control signal to the first emission control lines.

The first emission driver may include a first sub emission driver at a first side of the first pixel area; and a second sub emission driver at a second side of the first pixel area. The first sub emission driver may supply the first emission control signal to a first portion of the first emission control lines, and the second sub emission driver may supply the first emission control signal to a second portion of the first emission control lines.

The first sub emission driver may include a plurality of emission stage circuits to supply the first emission control signal to the portion of the first emission control lines, and the second sub emission driver may include a plurality of emission stage circuits to supply the first emission control signal to a second portion of the first emission control lines.

Emission stage circuits of the first sub emission driver may supply the first emission control signal to an odd-number-th first emission control lines, and emission stage circuits of the second sub emission driver may supply the first emission control signal to an even-number-th first emission control lines.

The second scan driver may include a third sub scan driver at a first side of the second pixel area to supply the second scan signal to a first portion of the second scan lines; and fourth sub scan driver arranged at a second side of the second pixel area to supply the second scan signal to a second portion of the second scan lines, and the second emission driver includes: a third sub emission driver at the second side of the second pixel area to supply the second emission control signal to a first portion of the second emission control lines; and a fourth sub emission driver at the first side of the second pixel area to supply the second emission control signal to a second portion of the second emission control lines.

The third scan driver may include a fifth sub scan driver at a first side of the third pixel area to supply a third scan signal to a first portion of the third scan lines; and sixth sub scan driver at a second side of the third pixel area to supply the third scan signal to a second portion of the third scan lines, and the third emission driver may include a fifth sub emission driver arranged at the first side of the third pixel area to supply the third emission control signal to a first portion of the third emission control lines; and a sixth sub emission driver at the second side of the third pixel area to supply the third emission control signal to a second portion of the third emission control lines.

First scan driver may include a first scan stage circuit to supply the first scan signal to the first scan line, and second scan driver may include a second scan stage circuit to supply the second scan signal to the second scan line. Sizes of transistors in the second scan stage circuit may be smaller than sizes of transistors in the first scan stage circuit.

The first scan stage circuit may include a first transistor connected between a first input terminal and a first scan line; a second transistor connected between a first output terminal and a second input terminal; and a first driving circuit to control the first transistor and the second transistor, and the second scan stage circuit may include a third transistor connected between a third input terminal and a second scan line; a fourth transistor connected between the second output terminal and a fourth input terminal; and a second driving circuit to control the third transistor and the fourth transistor. A ratio of a width to a length of a channel of the third transistor may be less than a ratio of a width to a length of a channel of the first transistor. A ratio of a width to a length of a channel of the fourth transistor may be less than a ratio of a width to a length of a channel of the second transistor.

The second transistor may include a plurality of first auxiliary transistors connected in parallel, and the fourth transistor may include a plurality of second auxiliary transistors connected in parallel. A number of second auxiliary transistors may be less than a number of first auxiliary transistors.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1A:
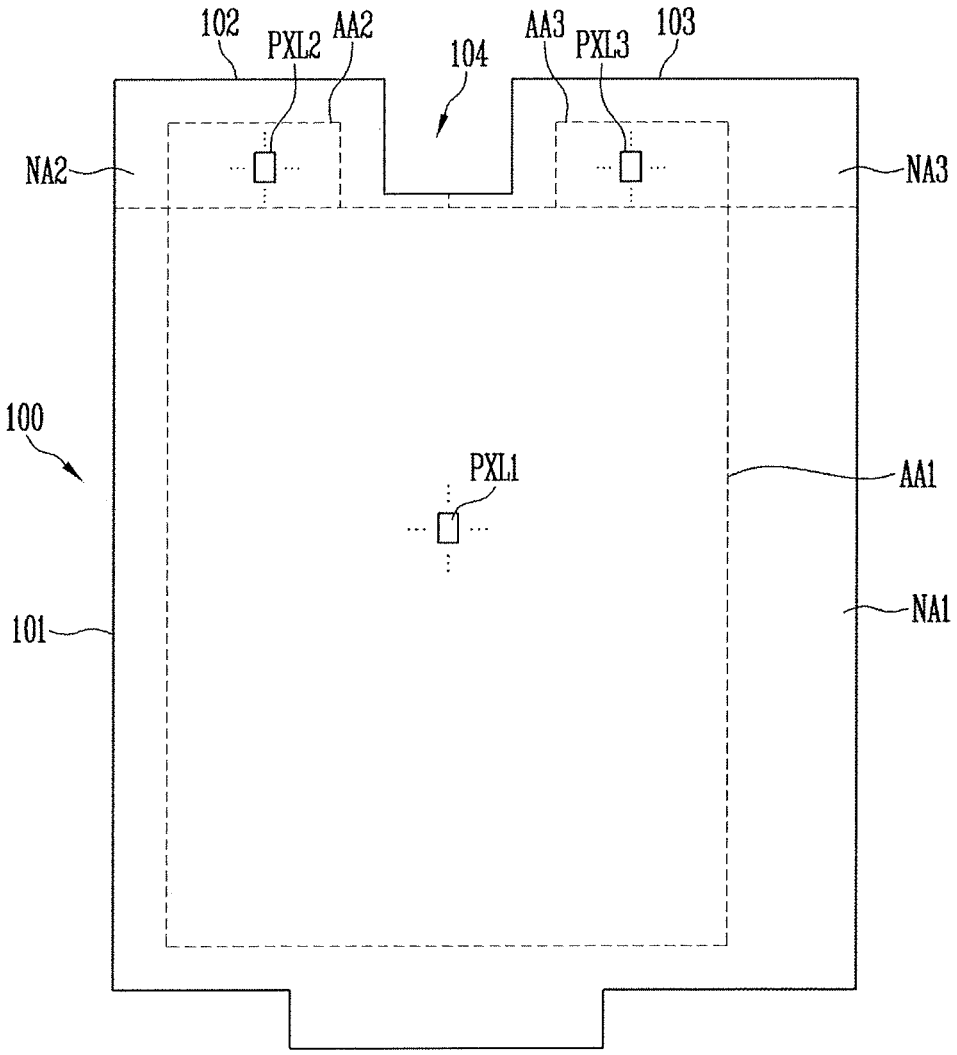
FIGS. 1A to 1D illustrate embodiments of pixel areas.

Example embodiments will now be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIGS. 1A to 1D illustrating embodiments of pixel areas. Referring to FIG. 1A, a substrate 100 may include pixel areas AA1, AA2 and AA3 and peripheral areas NA1, NA2. and NA3. A plurality of pixels PXL1, PXL2 and PXL3 may be located at the pixel areas AA1, AA2 and AA3 and predetermined image may be displayed at the pixel areas AA1, AA2 and AA3 accordingly. Thus, the pixel areas AA1, AA2 and AA3 may be designated as a display area.

Constituent elements (e.g., one or more drivers and wires) for driving the pixels PXL1, PXL2 and PXL3 may be located at the peripheral areas NA1, NA2, and NA3. Since the pixels PXL1, PXL2 and PXL3 are not located at the peripheral areas NA1, NA2, and NA3, the peripheral areas NA1, NA2, and NA3 may be designated as a non-display area.

For example, the peripheral areas NA1, NA2, and NA3 may be arranged outside of the pixel areas AA1, AA2 and AA3 and partially surround the pixel areas AA1, AA2 and AA3. The pixel areas AA1, AA2 and AA3 may include a first pixel area AA1, a second pixel area AA2 and a third pixel area AA3 arranged at one side of the first pixel area AA1. In addition, the second pixel area AA2 and the third pixel area AA3 may be spaced apart from each other. An area of the first pixel area AA1 may be the larger than that of the second pixel areas AA2 and that of the third pixel areas AA3.

In addition, respective areas of the second pixel area AA2 and the third pixel area AA3 may be smaller than the area of the first pixel area AA1, and respective areas of the second and third pixel areas AA2 and AA3 may be the same or different from each other.

The peripheral areas NA1, NA2, and NA3 may include a first peripheral area NA1, a second peripheral area NA2 and a third peripheral area NA3. The first peripheral area NA1 may be located outside of the first pixel area AA1 and surround at least a portion of the first pixel area AA1. A width of the first peripheral area NA1 may be equally determined overall. In other embodiments, the width of the first peripheral area NA1 may be different.

The second peripheral area NA2 may be located outside of the second pixel area AA2 and surround at least a portion of the second pixel area AA2. A width of the second peripheral area NA2 may be equally determined overall. In other embodiments, the width of the second peripheral area NA2 may be different.

The third peripheral area NA3 may be located outside of the third pixel area AA3 and surround at least a portion of the third pixel area AA3. A width of the third peripheral area NA3 may be equally determined overall. In other embodiments, the width of the third peripheral area NA3 may be different. The second and third peripheral areas NA2 and NA3 may be connected to each other or not, for example, depending on a shape of the substrate 100.

Widths of the peripheral areas (NA1, NA2, and NA3) may be equally determined overall. In other embodiments, the widths of the peripheral areas may be different.

The pixels may include a first pixel PXL1, a second pixel PXL2 and a third pixel PXL3. For example, the first pixels PXL1 may be arranged at the first pixel area AA1, the second pixels PXL2 may be arranged at the second pixel area AA2, and the third pixels PXL3 may be arranged at the third pixel area AA3. The pixels PXL1 PXL2, and PXL3 may emit light with predetermined brightness based on control of the drivers at the peripheral areas NA1, NA2, and NA3. The pixels PXL1, PXL2, and PXL3 may include a light emitting element (e.g., an organic light emitting diode.)

The substrate 100 may be formed in various types in which the pixel areas AA1, AA2 and AA3 and the peripheral areas NA1, NA2 and NA3 are determined. For example, the substrate 100 may include a base substrate 100 on the substrate, a first auxiliary substrate 102 and a second auxiliary substrate 103 protruding from one end of the base substrate 101 to one side. The first auxiliary substrate 102 and the second auxiliary substrate 103 may be elongated from the base substrate 101 and formed in one body. A concave 104 may be between the first auxiliary substrate 102 and the second auxiliary substrate 103. The concave 104 may be formed by removing a portion of the substrate 100, such that the first and second auxiliary substrates 102 and 103 are spaced apart from each other.

The first and second auxiliary substrates 102 and 103 may have a smaller area than the base substrate 101, respectively. The respective areas of the first and second auxiliary substrates 102 and 103 are the same as or different from each other. The first and second auxiliary substrates 102 and 103 may be formed in various types in which the pixel areas AA1 and AA2 and the peripheral areas NA1 and NA2 are determined.

The first area AA1 and the first peripheral area NA1 may be defined on the base substrate 101. The second pixel area AA2 and the second peripheral area NA2 may be defined on the first auxiliary substrate 102. The third pixel area AA3 and the third peripheral area NA3 may be defined on the second auxiliary substrate 103. In addition, the second peripheral area NA2 and the third peripheral area NA3 may be connected each other between the concave 104 and the first pixel area AA1. In one embodiment, based on the shape of the first pixel area AA1, the second peripheral area NA2 and the third peripheral area NA3 may be not connected to each other.

The substrate 100 may be formed of insulating material such as glass and resin. In addition, the substrate may be formed of materials having flexibility, which enables the substrate 100 to be bent or folded in a single layer structure or a multilayer structure. For example, the substrate 100 may include one of polystyrene, polyvinyl alcohol, polymethyl methacrylate, polyether sulfone, polyacrylate, poly polyetherimide, polyethylene naphthalate, polyethylene terephthalate, polyphenylene sulfide, polyarylate, polyimide, polycarbonate, cellulose triacetate, or cellulose acetate propionate.

However, constituent materials of the substrate 100 may be variable, and the substrate 100 may be formed of fiber glass reinforced plastic (FRP), etc.

Figure 1B:
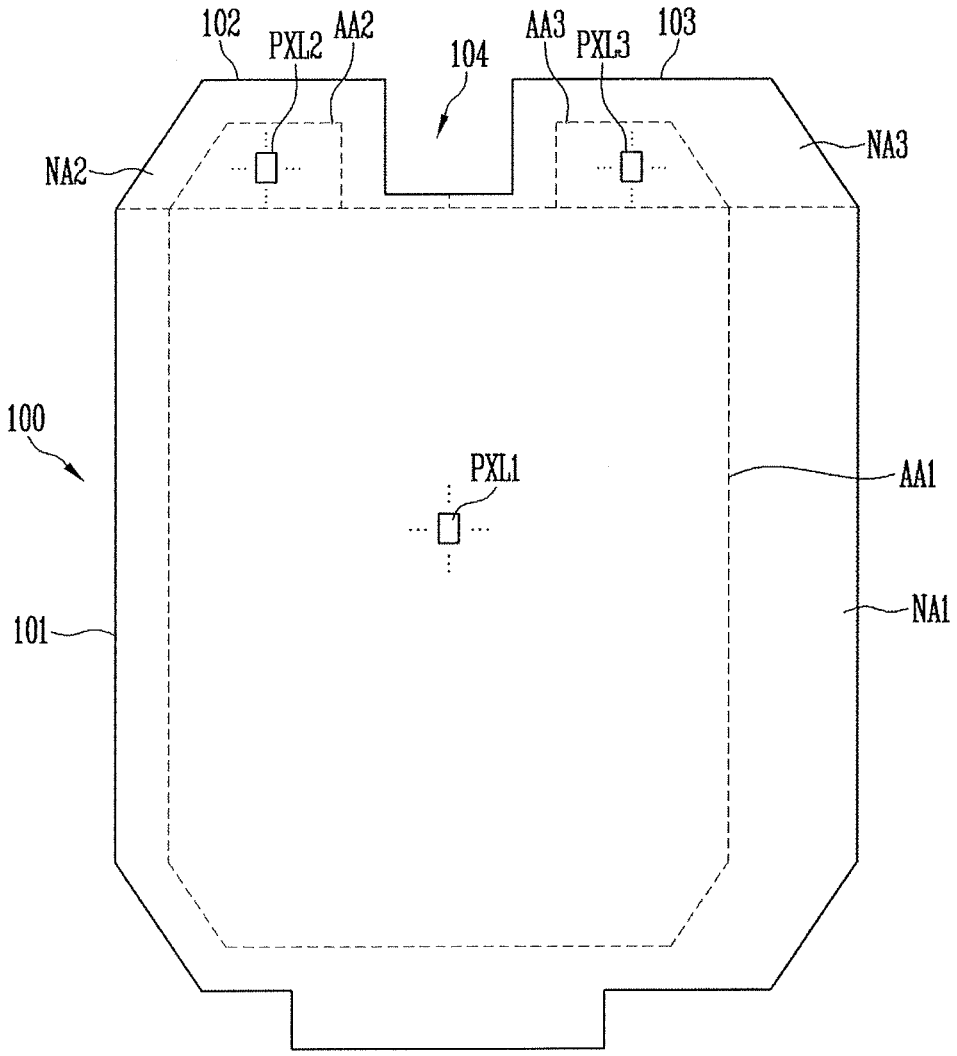

The first pixel area AA1 may have various shapes. For example, the first pixel area AA1 may have a polygonal shape, a circular shape, etc. In addition, at least a portion of the first pixel area AA1 may have a curved shape. For example, the first pixel area AA1 may have a rectangular shape as in FIG. 1A. Referring to FIG. 1B, a corner part of the first pixel area AA1 may be modified to an inclined shape. The corner part of the first pixel unit AA1 may be modified to the curved shape.

The base substrate 101 may have various shapes. For example, the base substrate 101 may have the polygonal shape, the circular shape, etc. In addition, at least a portion of the base substrate 101 may have the curved shape. For example, the base substrate 101 may have the rectangular shape as in FIG. 1A. Referring to FIG. 1B, a corner part of the base substrate 101 may be modified to the inclined shape. The corner part of the base substrate 101 may be modified to the curved shape. The base substrate 101 may have a shape the same as or similar to the first pixel area AA1 or a different shape from the first pixel area AA1.

The second pixel area AA2 and the third pixel area AA3 may have various shapes, respectively. For example, the second pixel area AA2 and the third pixel area AA3 may have the polygonal shape, the circular shape, etc. In addition, at least portions of the second pixel area AA2 and the third pixel area AA3 may have the curved shape.

Figure 1C:
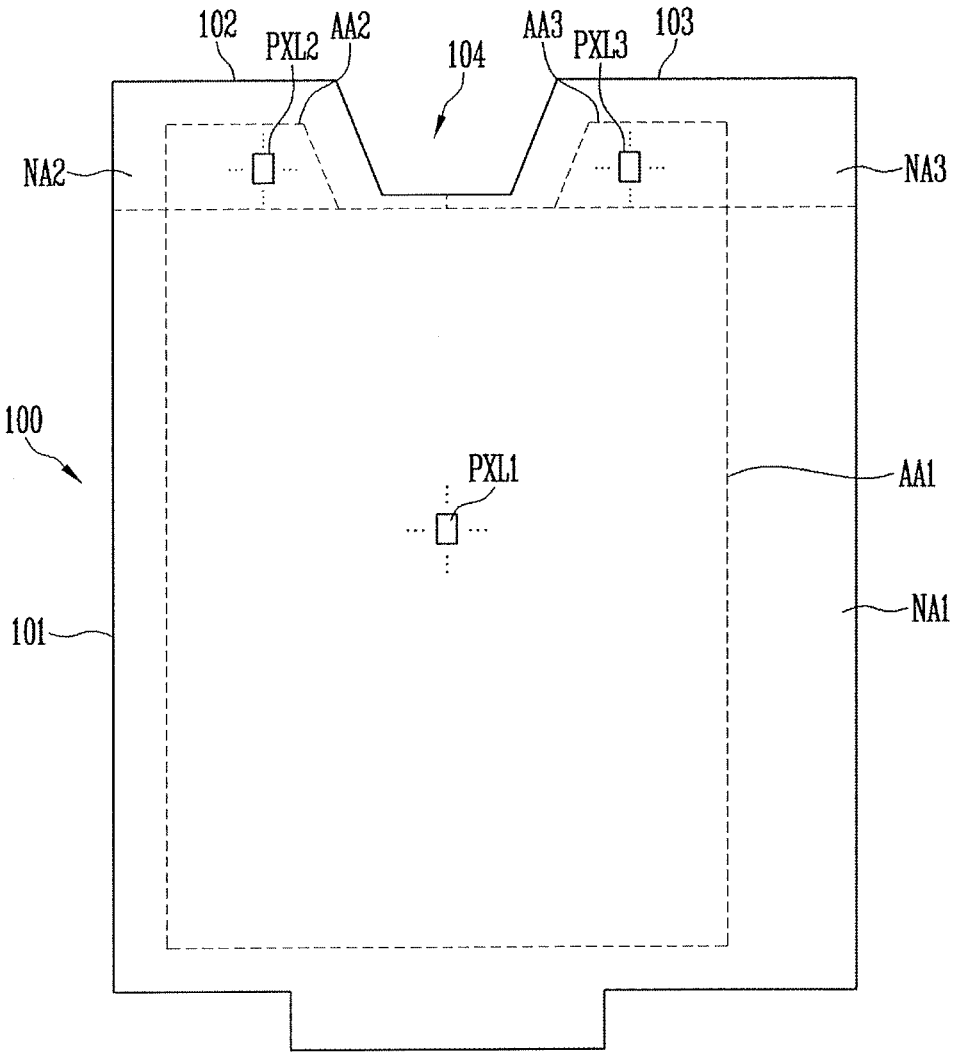
Figure 1D:
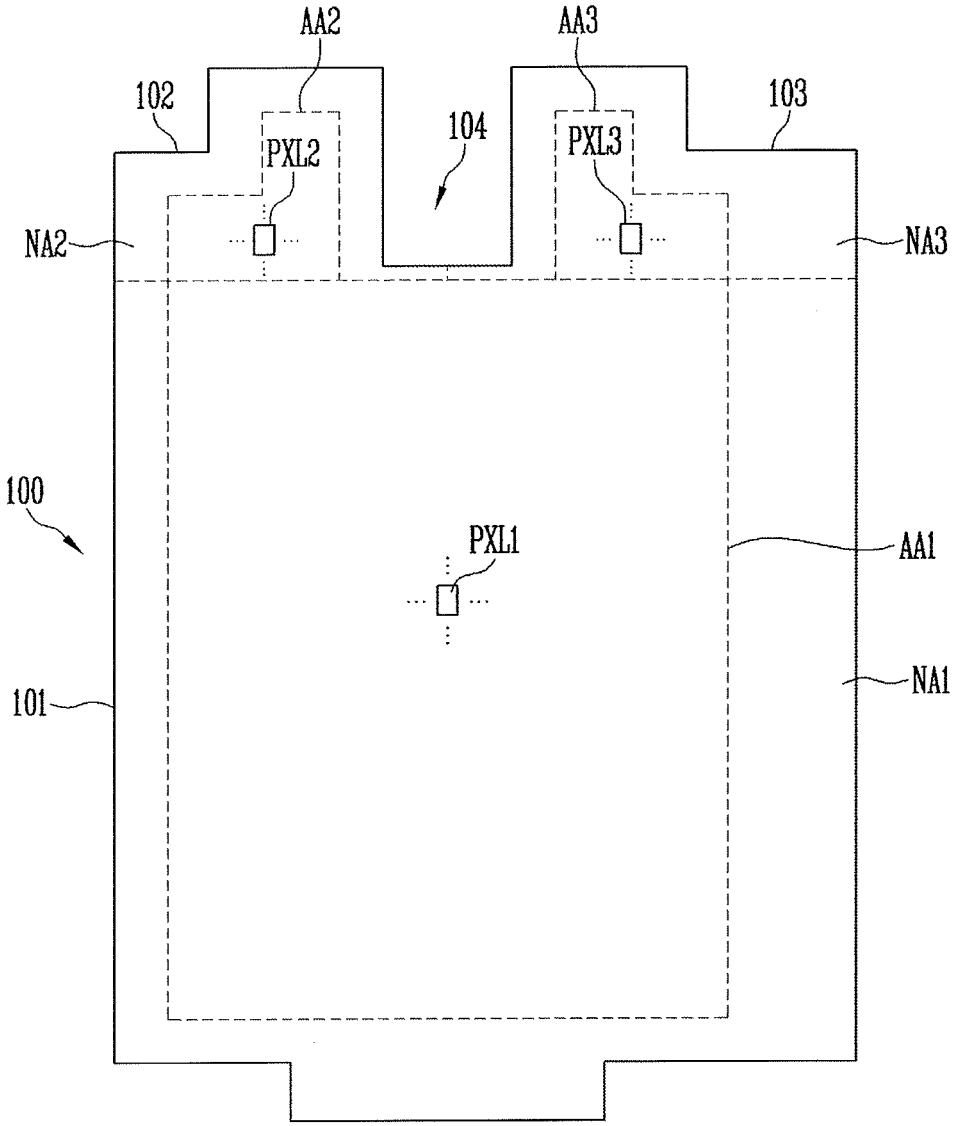

For example, the second pixel area AA2 and the third pixel area AA3 may have the rectangular shape as in FIG. 1A, respectively. Referring to FIGS. 1B and 1C, outside corner parts and inside corner parts of the second pixel area AA2 and the third pixel area AA3 may be modified to the inclined shape, respectively. The corner parts of the second pixel area AA2 and the third pixel area AA3 may be modified to the curved shape. In addition, referring to FIG. 1D, the corner parts of the second pixel area AA2 and the third pixel area AA3 may be modified to a stair shape, respectively.

The first auxiliary substrate 102 and the second auxiliary substrate 103 may have various shape. For example, the first auxiliary substrate 102 and the second auxiliary substrate 103 may the polygonal shape, the circular shape, etc. In addition, at least portions of the first auxiliary substrate 102 and the second auxiliary substrate 103 may have the curved shape.

For example, the first auxiliary substrate 102 and the second auxiliary substrate 103 may the rectangular shape as in FIG. 1A. respectively. Referring to FIGS. 1B and 1C, outside corner parts and the inside corner parts of the first auxiliary substrate 102 and the second auxiliary substrate 103 may be modified to the inclined shape, respectively. The corner parts the first auxiliary substrate 102 and the second auxiliary substrate 103 may be modified to the curved shape. In addition, referring to FIG. 1D, the corner parts of the first auxiliary substrate 102 and the second auxiliary substrate 103 may be modified to the stair shape, respectively.

The first auxiliary substrate 102 and the second auxiliary substrate 103 may have shape the same as or similar to the second pixel area AA2 and the third pixel area AA3, respectively. In another embodiment, the first auxiliary substrate 102 and the second auxiliary substrate 103 may have different shapes from the second pixel area AA2 and the third pixel area AA3.

The concave 104 may have various shapes. For example, the concave 104 may have a polygonal shape, circular shape, etc. In addition, at least a portion of the concave 104 may have a curved shape.

Figure 2:
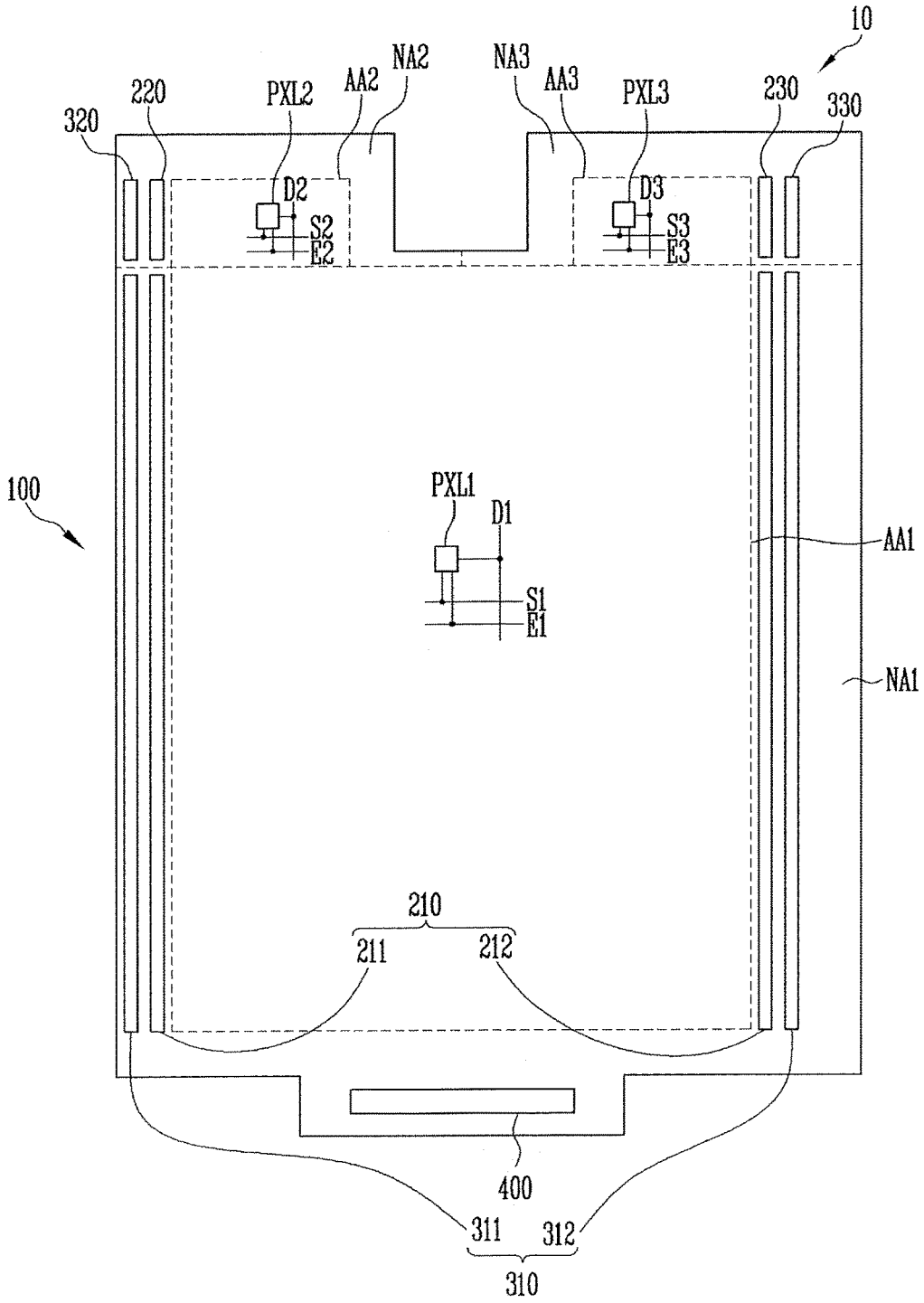
FIG. 2 illustrates an embodiment of a display device.

FIG. 2 illustrates an embodiment of a display device 10 which includes the pixel areas (AA1, AA2, and AA3) relating to FIG. 1A. In other embodiments, the display device 10 may include the pixel areas (AA1, AA2, and AA3) in FIGS. 1B to 1D.

Referring to FIG. 2 the display device 10 may include the substrate 100, the first pixels PXL1, the second pixels PXL2, the third pixels PXL3, a first scan driver 210, a second scan driver 220, a third scan driver 230, a first emission driver 310, a second emission driver 320 and a third emission driver 330. The first pixels PXL1 may be located at the first pixel area AA1. Each of the first pixels PXL1 may be connected to a first scan line S1, a first emission control line EL, and a first data line D1.

The first scan driver 210 may supply a first scan signal to the first pixels PXL1 through the first scan lines S1. For example, the first scan driver 210 may sequentially supply the first scan signal to the first scan lines S1. The first scan driver 210 may be located at the first peripheral area NA1 and include a first sub scan driver 211 and a second sub scan driver 212 at different sides of the first pixel area AA1. For example, the first sub scan driver 211 may be at one side of the first pixel area AA1 (for example, the left side in FIG. 2), and the second sub scan driver 212 may be at another side of the first pixel area AA1 (for example, the right side in FIG. 2).

The first sub scan driver 211 and the second sub scan driver 212 may partially drive the first scan lines S1 and omit the first sub scan driver 211 and the second sub scan driver 212 as needed.

The first emission driver 310 may supply a first emission control signal to the first pixels PXL1 through first emission control lines E1. For example, the first emission driver 310 may sequentially supply the first emission control signal to the first emission control lines E1. The first emission driver 310 may be arranged at the first peripheral area NA1 and include a first sub emission driver 311 and a second sub emission driver 312 positioned at both side of the first pixel area AA1. For example, the first sub emission driver 311 may be at one side of the first pixel area AA1 (for example, the left side in FIG. 2), and the second sub emission driver 312 may be at another side of the first pixel area AA1 (for example, the right side in FIG. 2).

The first sub emission driver 311 and the second sub emission driver 312 may partially drive the first emission control lines. One of the first sub emission driver 311 and the second sub emission driver 312 may be omitted.

FIG. 2 illustrates the first sub emission driver 311 outside the first sub scan driver 211, but the first sub emission driver 311 may be inside the first sub scan driver 211 the other way around. In addition, FIG. 2 illustrates the second sub emission driver 312 outside of the second sub scan driver 212, but the second sub emission driver 312 may be inside of the second sub scan driver 212 the other way around.

The second pixels PXL2 may be located at the second pixel area AA2. Each of the second pixels PXL2 may be connected to a second scan line S2, a second emission control line E2, and a second data line D2. The second scan driver 220 may supply a second scan signal to the second pixels PXL2 through the second scan lines S2. For example, the second scan driver 220 may sequentially supply the second scan signal to the second scan lines S2. The second scan driver 220 may be at one side of the second peripheral area NA2 (for example, the left side in FIG. 2).

The second emission driver 320 may supply the second emission control signal to the second pixels PXL2 thorough second emission control lines E2. For example, the second emission driver 320 may sequentially supply the second emission signal to the second emission control lines E2. The second emission driver 320 may be at one side of the second peripheral area NA2 (for example, the left side in FIG. 2). For example, the second scan driver 220 and the second emission driver 320 may be at one side of the second pixel area AA2 (for example, the left side in FIG. 2).

The second emission driver 320 may be outside the second scan driver 220 as in FIG. 2, but the second emission driver 320 may be inside of the second scan driver 220 the other way around. In addition, the positions of the second scan driver 220 and the second emission driver 320 adjacent to each other may be changed. For example, the second scan driver 220 and the second emission driver 320 may be at another side of the second pixel area AA2 (for example, the right side in FIG. 2).

Since the second pixel area AA2 has a smaller area than the first pixel area AA1, the lengths of the second scan line S2 and the second emission control line E2 may be shorter than those of the first scan line S1 and the first emission control line E1. In addition, the number of second pixels PXL2 connected to one second scan line S2 may be less than that of first pixels PXL1 connected to one first scan line S1. The third pixels PXL3 may be arranged at the third pixel area AA3 and connected to a third scan line S3, a third emission control line E3, and a third data line D3, respectively.

The third scan driver 230 may supply a third scan signal to the third pixels PXL3 through the third scan lines S3. For example, the third scan driver 230 may sequentially supply the third scan signal to the third scan lines S3. The third scan driver 230 may be at one side of the third peripheral area NA3 (for example, the right side in FIG. 2).

The third emission driver 330 may supply a third emission control signal to the third pixels PXL3 through the third emission control lines E3. For example, the third emission driver 330 may sequentially supply the third emission control signal to the third emission control lines E3. The third emission driver 330 may be at one side of the third peripheral area NA3 (for example, the right side in FIG. 2). For example, the third scan driver 230 and the third emission driver 330 may be at one side of the third pixel area AA3 (for example, the right side in FIG. 2).

The third emission driver 330 may be outside of the third scan driver 230 as in FIG. 2. In another embodiment, the third emission driver 330 may be inside the third scan driver 230 the other way around.

In addition, the positions of the third scan driver 230 and the third emission driver 330 adjacent to each other may be changed. For example, the third scan driver 230 and the third emission driver 330 may be at another side of the third pixel area AA3 (for example, the right side in FIG. 2).

Since the third pixel area AA3 has a smaller area than the first pixel area AA1, the lengths of the third scan line S3 and the third emission control line E3 may be shorter than those of the first scan line S1 and the first emission control line E1. In addition, the number of third pixels PXL3 connected to one third scan line S3 may be less than that of first pixels PXL1 connected to one first scan line S1.

Such emission control signal may be used for controlling emission time of the pixels PXL1, PXL2, and PXL3. To this end, the emission signal may have width greater than the scan signal. Additionally, the emission signal may be set to a gate off voltage (for example, a high level voltage) so that a transistor in each of the pixels PXL1, PXL2, and PXL3 may be turned off and to a gate on voltage (for example, a low level voltage) so that the transistor each of in the pixels PXL1, PXL2 and PXL3 may be turned on.

The data driver 400 may supply a data signal to the pixels PXL1, PXL2, and PXL3 through data lines D1, D2 and D3

Second data lines D2 may be connected a portion of first data lines D1, and third data lines D3 may be connected to another portion of the first data lines D1. For example, the second data lines D2 may be elongated from a portion of the first data lines D1, and the third data lines D3 may be elongated from another portion of the first data lines D1.

The data driver 400 may be arranged at the first peripheral area NA1, for example, at a portion which does not overlap the first scan driver 210 (for example, the lower side of the first pixel area AA1 in FIG. 2.)

Figure 3:
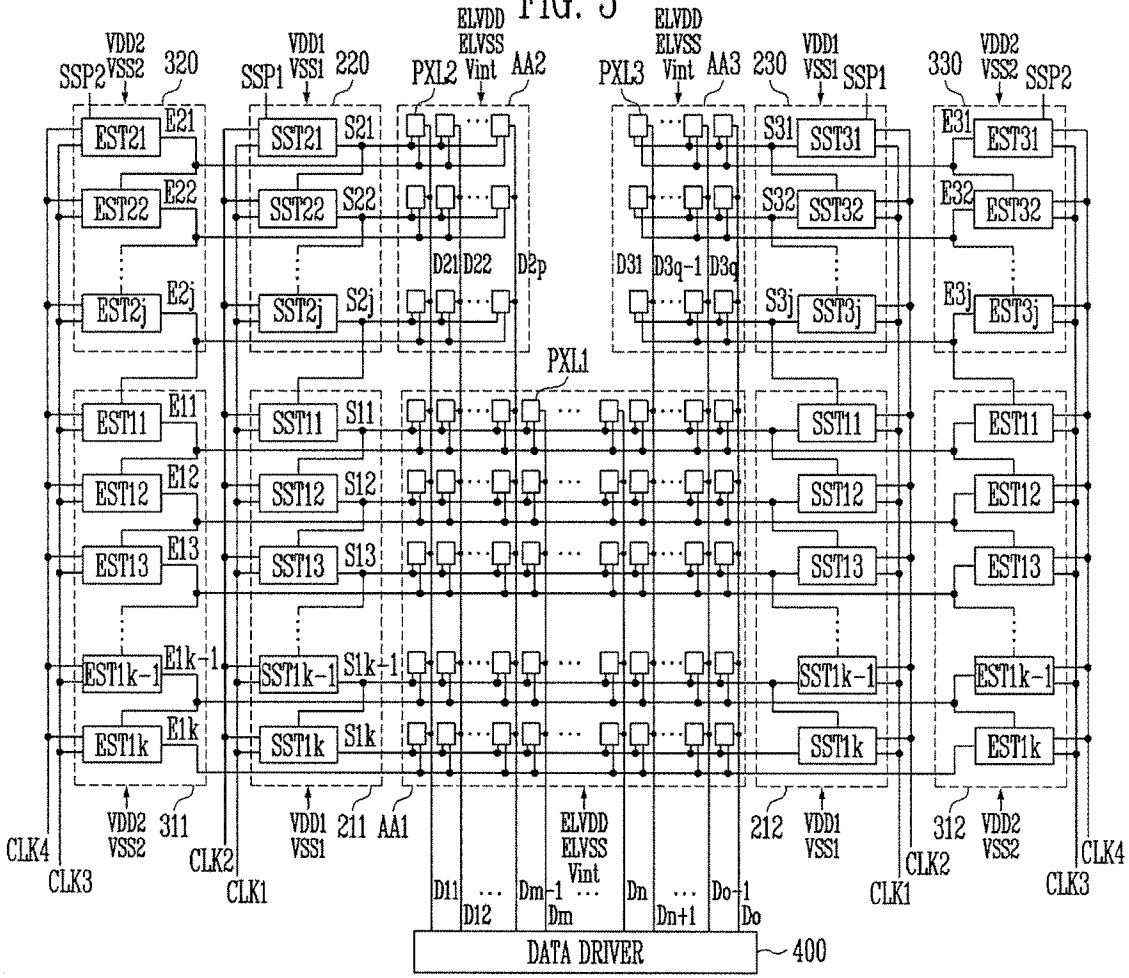
FIG. 3 illustrates an embodiment of a scan driver and a emission driver.

FIG. 3 illustrates an embodiment of a scan driver and a emission driver as in FIG. 2. Referring to FIG. 3, a first sub scan driver 211 may be connected to one side of first scan lines S11 to S1*k* and a second sub scan driver 212 may be connected to the other side of the first scan lines S11 to S1*k*. Thus, the first scan lines S11 to S1*k* may be connected between the first sub scan driver 211 and the second sub scan driver 212.

To prevent delay of the scan signal, the first sub scan driver 211 and the second sub scan driver 212 may concurrently supply the first scan signal for the same scan line. For example, a first scan line S11 may concurrently receive the first scan signal from the first sub scan driver 211 and the second sub scan driver 212. A second scan line S12 may concurrently receive the first scan signal from the first sub scan driver 211 and the second sub scan driver 212. The first sub scan driver 211 and the second sub scan driver 212 may sequentially supply the first scan signal to the first scan lines S11 to S1*k*.

The first sub scan driver 211 may include a plurality of scan stage circuits SST11 to SST1*k*. The scan stage circuits SST11 to SST1*k* of the first sub scan driver 211 may be connected to one side of the first scan lines S11 to S1*k*, respectively and supply the first scan signal to each of the first scan lines S11 to S1*k*.

The scan stage circuits SST11 to SST1*k* may operate based on clock signals CLK1 and CLK2 from an external source. The scan stage circuits SST11 to SST1*k* may be implemented to have a same or similar circuit structure.

The scan stage circuits SST11 to SST1*k* may receive an output signal (that is, a scan signal) of a previous scan stage circuit or a start pulse. For example, a first scan stage circuit SST11 may receive the start pulse and remaining scan stage circuits SST12 to SST1*k* may receive the output signal (scan signal) of the previous scan stage circuit As shown in FIG. 3, the first scan stage circuit SST11 of the first sub scan driver 211 may use a signal output from the last scan stage circuit SST2*j* of the second scan driver 220 as the start pulse. In another embodiment, the first scan stage circuit SST11 of the first sub scan driver 211 may not receive the signal output from the last stage circuit SST2*j* of the second scan driver 220 but receive a separate start pulse.

Each of the scan stage circuits SST11 to SST1*k* may receive a first driving power VDD1 and a second driving power VSS1. The first driving power VDD1 may be set to the gate off voltage, for example, the high level voltage. The second driving power VSS1 may be set to the gate on voltage, for example, the low level voltage.

The second sub scan driver 212 may include a plurality of scan stage circuits SST11 to SST1*k*. Each of the scan stage circuits SST11 to SST1*k* of the second sub scan driver 212 may be connected to the other side of the first scan lines S11 to S1*k* and supply the first scan signal to each of the first scan lines S11 to S1*k*. The scan stage circuits SST11 to SST1*k* of the second sub scan driver 212 may have the same structure as the first sub scan driver 211.

Referring to FIG. 3, the first sub emission driver 311 may be connected to one side of the first emission control lines E11 to E1*k* and the second sub emission driver 312 may be connected to the other side of the first emission control lines E11 to E1*k*. Thus, the first emission control lines E11 to E1*k* may be connected between the first sub emission driver 311 and the second sub emission driver 312.

To prevent delay of the emission control signal, the first sub emission driver 311 and the second sub emission driver 312 may concurrently supply the first emission control signal for the same emission control line. For example, the first emission control line E11 may receive the first light emission control signal from the first sub emission driver 311 and the second sub emission driver 312. The second emission control line E12 may receive the first light emission control signal from the first sub emission driver 311 and the second sub emission driver 312. As such, the first sub emission driver 311 and the second sub emission driver 312 may sequentially supply the first emission control signal to the first emission control lines E11 to E1*k*.

The first sub emission driver 311 may include a plurality of emission stage circuits EST11 to EST1*k*. Each of the emission stage circuits EST11 to EST1*k* of first sub emission driver 311 may be connected to one side of the first emission control lines E11 to E1*k*, and supply the first emission control signal to the first emission control lines E11 to E1*k*.

The emission stage circuits EST11 to EST1*k* may operate based on clock signals CLK3 and CLK4 provided from the external source. In addition, the emission stage circuits EST11 to EST1*k* may be implemented as the same circuit. The emission stage circuits EST11 to EST1*k* may receive the output signal (emission control signal) of the previous emission stage circuit or the start pulse. For example, the first emission stage circuit EST11 may receive the start pulse and remaining first emission stage circuits EST12 to EST1*k* may receive the output signal of the previous emission stage circuit.

As shown in FIG. 3, the first emission stage circuit EST11 of the first sub emission driver 311 may use the signal from the last emission stage circuit EST2*j* of the second emission driver 320 as the start pulse. In another embodiment, the first emission stage circuit EST11 of the first sub emission driver 311 may not receive the signal from the last emission stage circuit EST2*j* of the second emission driver 320, but may receive the separate start pulse.

Respective emission stage circuits EST11 to EST1*k* may receive a third driving power VDD2 and a fourth driving power VSS2. The third driving power VDD2 may be set to the gate off voltage, for example, the high level voltage. The fourth driving power VSS2 may be set to the gate on voltage, for example, the low level voltage. In addition, the third driving power VDD2 may have the same voltage as the first driving power VDD1. and the fourth driving power VSS2 may have the same voltage as the second driving power VSS1.

The second sub emission driver 312 may include a plurality of emission stage circuits EST11 to EST1*k*. The emission stage circuits EST11 to EST1*k* of the second sub emission driver 312 may be connected to the other side of the first emission control lines E11 to E1*k*, respectively, and supply the first light emitting control signal to each of the first light emitting control lines E11 to E1*k*. The emission stage circuits EST11 to EST1*k* of the second sub emission driver 312 may have the same structure as the first sub emission driver 311.

The first pixels PXL1 arranged at the first pixel area AA1 may receive the data signal from the data driver 400 through the data lines D11 to Do. In addition, the first pixels PXL1 may receive a first pixel power ELVDD, a second pixel power ELVSS and a reset power Vint.

The first pixels PXL1 may receive the data signal from the first data lines D11 to Do when the first scan signal is supplied to the first scan lines S11 to S1*k*. The first pixels PXL1 that receive the data signal may control the amount of current flowing from the first pixel power ELVDD to the second pixel power ELVSS, via the organic light emitting diode. In addition, the number of first pixels PXL1 arranged at a line (row or column) may be changed depending on the positions thereof.

On the other side, referring to FIG. 3, the second scan driver 220 may be connected to one side of the second scan lines S21 to S2*j*. The second scan driver 220 may include a plurality of scan stage circuits SST21 to SST2*j*. The scan stage circuits SST21 to SST2*j* of the second scan driver 220 may be connected to one side of the second scan lines S21 to S2*j*, respectively, and supply the second scan signal to each of the second scan lines S21 to S2*j*.

The scan stage circuits SST21 to SST2*j* may operate based on the clock signals CLK1 and CLK2 from the external source. In addition, the scan stage circuits SST21 to SST2*j* may be implemented as the same circuit.

The scan stage circuits SST21 to SST2*j* may receive the output signal (scan signal) of the previous scan stage circuit or a start pulse SSP1. For example, a first scan stage circuit SST21 may receive the start pulse SSP1 and remaining scan stage circuits SST22 to SST2*j* may receive the output signal of the previous scan stage circuit In addition, the last scan stage circuit SST2*j* of the second scan driver 220 may supply the output signal to the first scan stage circuit SST11 of the first sub scan driver 211.

Each of the scan stage circuits SST21 to SST2*j* may receive the first driving power VDD1 and the second driving power VSS1. The first driving power VDD1 may be set to the gate off voltage, for example, the high level voltage. The second driving power VSS1 may be set to the gate on voltage, for example, the low level voltage.

The second emission driver 320 may be connected to one side of the second emission control lines E21 to E2*j*. The second emission driver 320 may include a plurality of emission stage circuits EST21 to EST2*j*. The emission stage circuits EST21 to EST2*j* of the second emission driver 320 may be connected to one side of the second emission control lines E21 to E2*j*, respectively, and supply the second emission control signal to each of the second emission control lines E21 to E2*j*.

The emission stage circuits EST21 to EST2*j* may operate based on the clock signals CLK3 and CLK4 from the external source. In addition, the emission stage circuits EST21 to EST2*j* may be implemented as the same circuit.

The emission stage circuits EST21 to EST2*j* may receive the output signal (emission control signal) of the previous emission stage circuit or a start pulse SSP2. For example, a first emission stage circuit EST21 may receive the start pulse SSP2 and remaining emission stage circuits EST22 to EST2*j* may receive the output signal of the previous emission stage circuit. In addition, a last emission stage circuit EST2*j* of the second emission driver 320 may supply the output signal to the first emission stage circuit EST11 of the first sub emission driver 311.

Each of the emission stage circuits EST22 to EST2*j* may receive the third driving power VDD2 and the fourth driving power VSS2. The third driving power VDD2 may be set to the gate off voltage, for example, the high level voltage. The fourth driving power VSS2 may be set to the gate on voltage, for example, the low level voltage.

The second pixels PXL2 arranged at the second pixel area AA2 may receive the data signal from the data driver 400 through second data lines D21 to D2*p*. For example, the second data lines D21 to D2*p* may be connected to a portion of the first data lines D11 to Dm1. In addition, the second pixels PXL2 may receive the first pixel power ELVDD, the second pixel power ELVSS, and the reset power Vint.

The second pixels PXL2 may receive the data signal from the second data lines D21 to D2*p* when the second scan signal is supplied to the second scan lines S21 to S2*j*. The second pixels PXL2 that receive the data signal may control the amount of current which flows from the first pixel power ELVDD to the second pixel power ELVSS via the organic light emitting diode. The number of second pixels PXL2 arranged at a line (row or column) may be different in other embodiments.

On the other hand, referring to FIG. 3, the third scan driver 230 may be connected to one side of the third scan lines S31 to S3*j*. The third scan driver 230 may include a plurality of stage circuits SST31 to SST3*j*. The scan stage circuits SST31 to SST3*j* of the third scan driver 230 may be connected to one side of the third scan lines S31 to S3*j*, respectively, and supply the third scan signal to each of the third scan lines S31 to S3*j*.

The scan stage circuits SST31 to SST3*j* may operate based on the clock signals CLK1 and CLK2 from the external source. The scan stage circuits SST31 to SST3*j* may have, for example, the same circuit structure. The scan stage circuits SST31 to SST3*j* may receive the output signal (scan signal) of the previous scan stage circuit or the start pulse SSP1. For example, a first scan stage circuit SST31 may receive the start pulse SSP1 and remaining scan stage circuits SST32 to SST3*j* may receive the output signal of the previous scan stage circuit In addition, the last scan stage circuit SST3*j* of the third scan driver 320 may supply the output signal to the first scan stage circuit SST11 of the second sub scan driver 212.

Each of the scan stage circuits SST31 to SST3*j* may receive the first driving power VDD1 and the second driving power VSS1. The first driving power VDD1 may be set to the gate off voltage, for example, the high level voltage. The second driving power VSS1 may be set to the gate on voltage, for example, the low level voltage. The third emission driver 330 may be connected to one side of the third emission control lines E31 to E3*j*.

The third emission driver 330 may include a plurality of emission stage circuits EST31 to EST3*j*. The emission stage circuits EST31 to EST3*j* of the third emission driver 330 may be connected to one side of the third emission control lines E31 to E3*j*, respectively, and supply the third emission control signal to each of the third emission control lines E31 to E3*j*.

The emission stage circuits EST31 to EST3*j* may operate based on the clock signals CLK3 and CLK4 from the external source. In addition, the emission stage circuits EST31 to EST3*j* may be implemented as the same circuit. The emission stage circuits EST31 to EST3*j* may receive the output signal (emission control signal) of the previous emission stage circuit or the start pulse SSP2. For example, a first emission stage circuit EST31 may receive the start pulse SSP2 and remaining emission stage circuits EST31 to EST3*j* may receive the output signal of the previous emission stage circuit In addition, the last emission stage circuit EST3*j* of the third emission driver 330 may supply the output signal to the first emission stage circuit EST11 of the second sub emission driver 312.

Each of the emission stage circuits EST31 to EST3*j* may receive the third driving power VDD2 and the fourth driving power VSS2. The third driving power VDD2 may be set to the gate off voltage, for example, the high level voltage and the fourth driving power VSS2 may be set to the gate on voltage, for example, the low level voltage.

The third pixels PXL3 arranged at the third pixel area AA3 may receive the data signal from the data driver 400 through third data lines D31 to D3*q*. For example, the third data lines D31 to D3*q* may be connected to a portion of the first data lines Dn+1 to Do. In addition, the third pixels PXL3 may receive the first pixel power ELVDD, the second pixel power ELVSS, and the reset power Vint.

The third pixels PXL3 may receive the data signal from the third data lines D31 to D3*q* when the third scan signal is supplied to the third scan lines S31 to S3*j*. The third pixels PXL3 that receive the data signal may control the amount of current which flows from the first pixel power ELVDD to the second pixel power ELVSS via the organic light emitting diode. The number of third pixels PXL3 arranged at the line (row or column) may be different in other embodiments.

Figure 4:
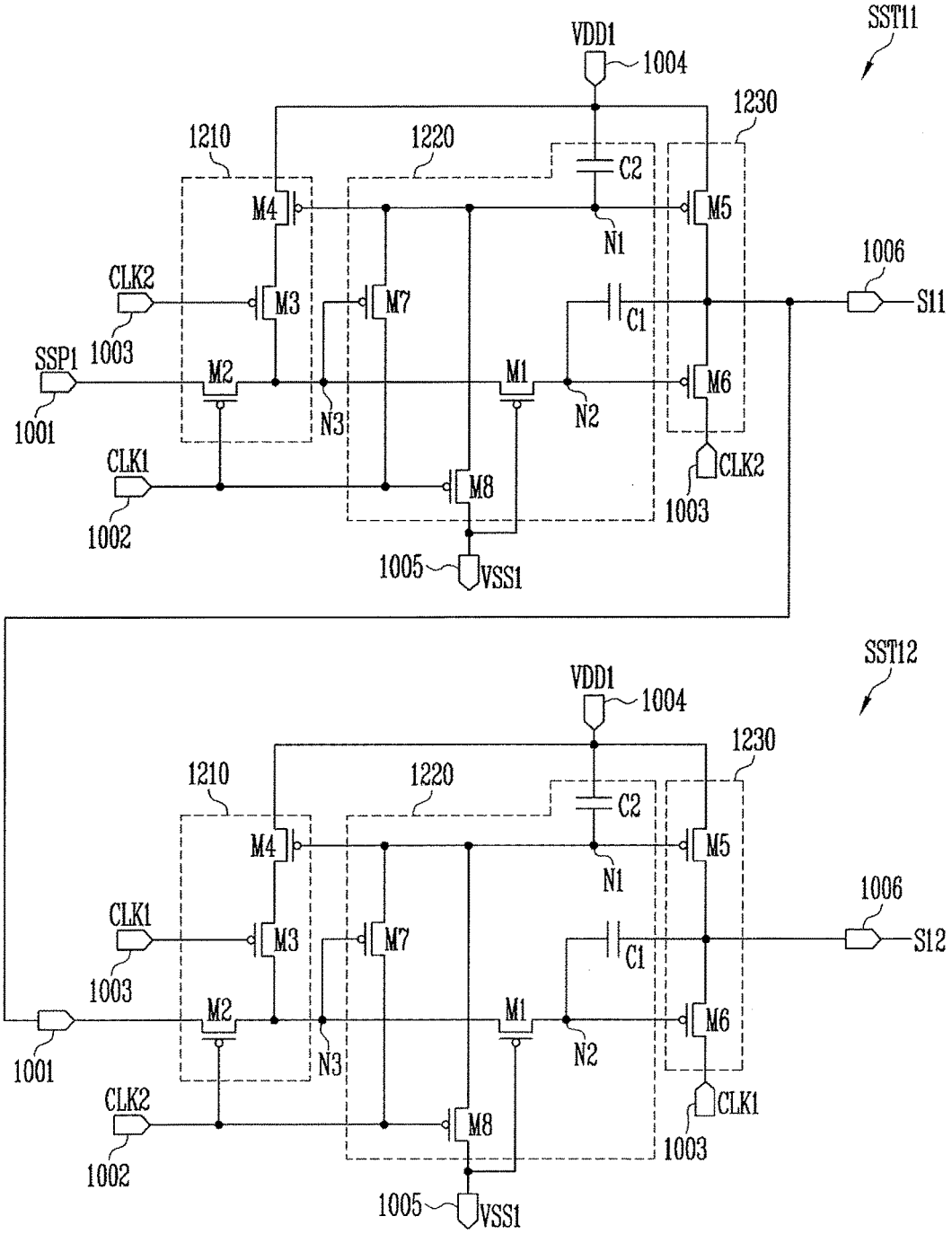
FIG. 4 illustrates an embodiment of a scan stage circuit.

FIG. 4A illustrates an embodiment of scan stage circuits. For the convenience of explanation, FIG. 4 illustrates the scan stage circuits SST11 and SST12 of the first sub scan driver 211.

Referring to FIG. 4, the first scan stage circuit SST11 may include a first driving circuit 1210, a second driving circuit 1220, and an output unit 1230. The output unit 1230 may control a voltage supplied to an output terminal 1006 corresponding to a voltage of a first node N1 and a second node N2.

The output unit 1230 may include a fifth transistor M5 and a sixth transistor M6. The fifth transistor M5 may be connected between a fourth input terminal 1004 and the output terminal 1006 in which the first driving power VDD1 is input. A gate electrode may be connected to the first node N1. The fifth transistor M5 may control the contact of the fourth input terminal 1004 and the output terminal 1006 corresponding to a voltage applied to the first node N1.

The sixth transistor M6 may be connected between the output terminal 1006 and a third input terminal 1003. The gate electrode may be connected to a second node N2. Such sixth transistor M6 may control the contact of the output terminal 1006 and the third input terminal 1003 based on a voltage applied to the second node N2.

The output unit 1230 may be driven by a buffer. In one embodiment, each of the fifth transistor M5 and/or the sixth transistor M6 may be replaced with a plurality of transistors connected in parallel.

The first driving circuit 1210 may control a voltage of a third node N3 corresponding to signals supplied to a first input terminal 1001 to the third input terminal 1003. The first driving circuit 1210 may include a second transistor to a fourth transistor M4. The second transistor M2 may be connected between the first input terminal 1001 and the third node N3. The gate electrode may be connected to a second input terminal 1002. The second transistor M2 may control a connection of the first input terminal 1001 and the third node N3 based on a signal supplied to the second input terminal 1002.

The third transistor M3 and the fourth transistor M4 may be connected in series between the third node N3 and the fourth input terminal 1004. The third transistor M3 may be connected between the fourth transistor M4 and the third node N3. The gate electrode may be connected to the third input terminal 1003. The third transistor M3 may control connection of the fourth transistor M4 and the third node N3 based on a signal supplied to the third input terminal 1003.

The fourth transistor M4 may be connected between the third transistor M3 and the fourth input terminal 1004. The gate electrode may be connected to the first node N1. The transistor M4 may control connection of the third transistor M3 and the fourth input terminal 1004 based on the voltage of the first node N1.

The second driving circuit 1220 may control the voltage of the first node N1 corresponding to the voltage of the second input terminal 1002 and the third node N3.

The second driving circuit 1220 may include a first transistor M1, a seventh transistor M7, an eighth transistor M8, a first capacitor C1, and a second capacitor C2. The first capacitor C1 may be connected between the second node N2 and the output terminal 1006. The first capacitor C1 may charge a voltage corresponding to a turn-on state and a turn-off state of the sixth transistor M6.

The second capacitor C2 may be connected between the first node N1 and the fourth input terminal 1004. The second capacitor C2 may charge the voltage applied to the first node N1.

The seventh transistor M7 may be connected between the first node N1 and the second input terminal 1002 and the gate electrode may be connected to the third node N3. The seventh transistor M7 may control connection of the first node N1 and the second input terminal 1002 based on a voltage of the third node N3.

The eighth transistor M8 may be between the first node N1 and a fifth input terminal 1005 corresponding to the second driving power VSS1. The gate electrode of the eighth transistor M8 may be connected to the second input terminal 1002. The eighth transistor M8 may control connection of the first node N1 and the fifth input terminal 1005 based on a signal of the second input terminal 1002.

The first transistor M1 may be connected between the third node N3 and the second node N2. The gate electrode may be connected to the fifth input terminal 1005. The first transistor M1 may be in a turn-on state to maintain electrical connection between the third node N3 and the second node N2. Additionally, the first transistor M1 may limit a falling width of the voltage of the third node N3 corresponding to the voltage of the second node N2. For example, although the voltage of the second node N2 may descend to a lower voltage than the second driving power VSS1, the voltage of the third node N3 may not be lower than a voltage of difference between the second driving power VSS land a threshold voltage of the first transistor.

The second scan stage circuit SST12 and remaining scan stage circuits SST13 to SST1*k* may have the same or similar structure as the first scan stage circuit SST11.

The second input terminal 1002 of a jth (j is an odd number or an even number) scan stage circuit SST1*j* may receive the first clock signal CLK1. The third input terminal 1003 of the jth scan stage circuit SST1*j* may receive the second clock signal CLK2. In addition, the second input terminal 1002 of a (j+1)th scan stage circuit SST1*j*+1 may receive the second clock signal CLK2. The third input terminal 1003 of the (j+1)th scan stage circuit SST1*j*+1 may receive the first clock signal CLK1.

The first and second clock signals CLK1 and CLK2 may have an equal period and phases thereof do not overlap each other. For example, when a period in which the scan signal is provided to one first scan signal S1 is designated as a first horizontal period 1H, each of the clock signals CLK1 and CLK2 may have a second horizontal period 2H and may be supplied in a different horizontal period from each other.

FIG. 4 illustrates an embodiment of a stage circuit in the first sub scan driver 211. The stage circuits in the other scan drivers (e.g., second sub scan driver 212, second scan driver 220, and third scan driver 230) in addition to the first sub scan driver 211 may have the same structure.

Figure 5:
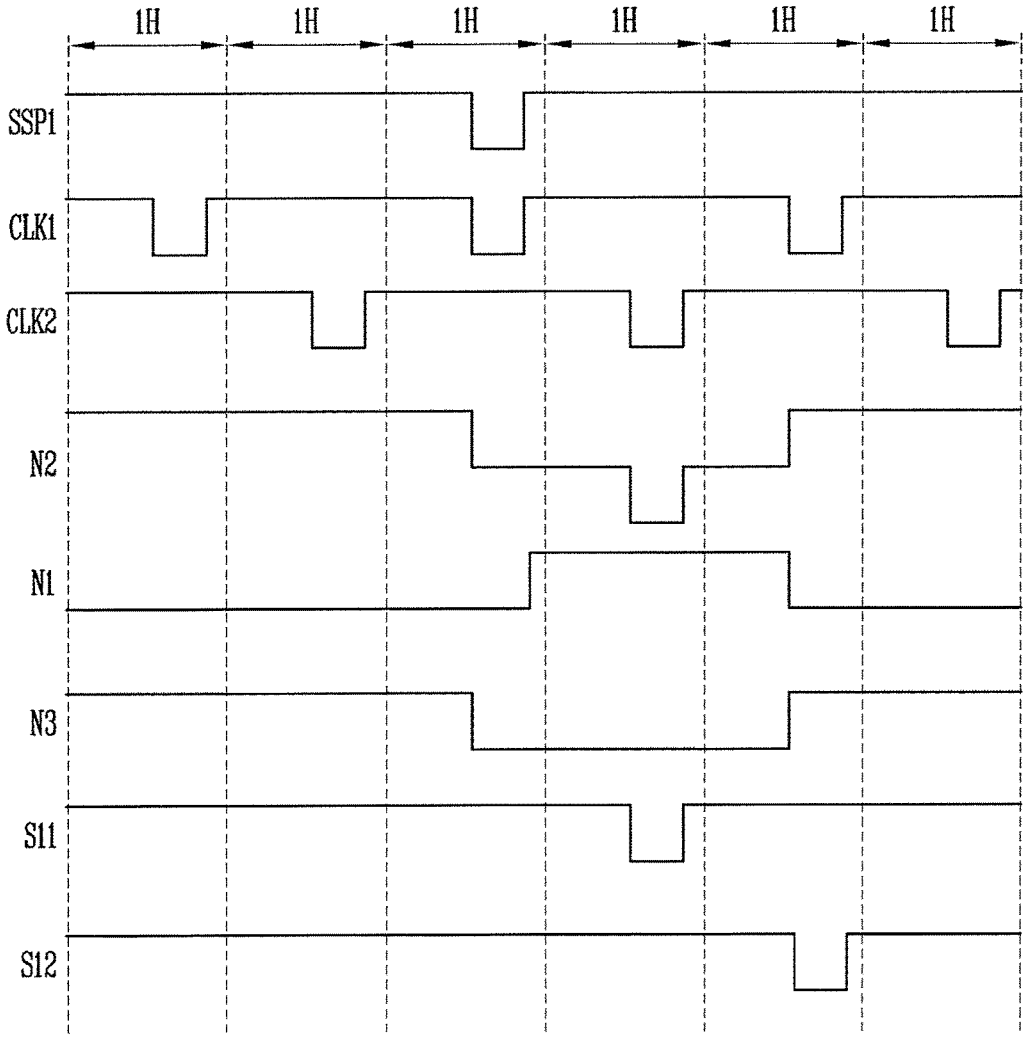
FIG. 5 illustrates an embodiment of a method for driving a scan stage circuit.

FIG. 5 illustrating an embodiment of a method for driving a scan stage circuit, which, for example, may be the scan stage circuit in FIG. 4. For the convenience of explanation, first scan stage circuit SST11 will be discussed as a representative example.

Referring to FIG. 5, the first clock signal CLK1 and the second clock signal CLK2 may have the second horizontal period 2H and be supplied in the different horizontal period from each other. For example, the second clock signal CLK2 may be set to a signal shifted by a half period (a first horizontal period) from the first clock signal CLK1. In addition, the first stat pulse SSP1 supplied to the first input terminal 1001 may be supplied to be synchronized with a clock signal supplied to the second input terminal 1002, which is the first clock signal CLK1.

In addition, when the first start pulse SSP1 is supplied, the first input terminal 1001 may be set to a voltage of the second driving power VSS. When the first start pulse SSP1 is not supplied, the first input terminal 1001 may be set to a voltage of the first driving power VDD1. Further, when the clock signals CLK1 and CLK2 are supplied to the second input terminal 1002 and the third input terminal 1003, the second input terminal 1002 and the third input terminal 1003 may be set to a voltage of the second driving power VSS1. When the clock signals CLK1 and CLK2 are not supplied to the second input terminal 1002 and the third input terminal 1003, the second input terminal 1002 and third input terminal 1003 may be set to a voltage of first driving power VDD1. The first start pulse SSP1 may be synchronized, for example, with the first clock signal CLK1. When the first clock signal CLK1 is supplied, the second transistor M2 and the eighth transistor M8 may be turned on. When the second transistor M2 is turned on, the first input terminal 1001 and the third node N3 may be electrically connected to each other. Since the first transistor M1 is turned on, the second node N2 and the third node N3 may maintain electrical connection.

When the first input terminal 1001 and the third node N3 are electrically connected to each other, the third node N3 and the second node N2 may be set to the low level voltage by the first start pulse SSP supplied to the first input terminal 1001. When the third node N3 and the second node N2 are set to the low level voltage, the sixth transistor M6 and the seventh transistor M7 may be turned on.

When the sixth transistor M6 is turned on, the third input terminal 1003 and the output terminal 1005 may be electrically connected to each other. The third input terminal 1003 may be set to the high level voltage (second clock signal CLK2 is not supplied). The high level voltage may be output to the output terminal 1006 accordingly. When the seventh transistor M7 is turned on, the second input terminal 1002 and the first node N1 may be electrically connected to each other. The voltage of the first clock signal CLK1 supplied to the second input terminal 1002, which is the low level voltage, may be supplied to the first node N1.

When the first clock signal CLK1 is supplied, the eighth transistor M8 may be turned on. When the eight transistor M8 is turned on, the voltage of the second driving power VSS1 may be supplied to the first node N1. The voltage of the second driving power VSS1 may be set to the same as (or similar to) the voltage of the first clock signal CLK1. As a result, the first node N1 may stably maintain the low level voltage.

When the first node N1 is set to the low level voltage, the fourth transistor M4 and the fifth transistor M5 may be turned on. When the fourth transistor is turned on, the fourth input terminal 1004 and the third transistor M3 are electrically connected to each other. Since the third transistor M3 is set to the turn-off state, the third node N3 may stably maintain the low level voltage, even though the fourth transistor M4 is turned on When the fifth transistor M5 is turned on, the voltage of the first driving power VDD1 may be supplied to the output terminal 1006. The voltage of the first driving power VDD1 may be set to the same voltage as the high level voltage supplied to the third input terminal 1003. As a result, the output terminal 1006 may stably maintain the high level voltage.

The supply the first stat pulse SSP1 and the first clock signal CLK1 may be discontinued. When the supply of the first clock signal CLK1 is discontinued, the second transistor M2 and the eighth transistor M8 may be turned off. The sixth transistor M6 and the sixth transistor M7 may maintain the turn-on state based on the voltage stored in the first capacitor C1. Thus, the second node N2 and the third node N3 may maintain the low level voltage based on the voltage stored in the first capacitor C1.

When the sixth transistor M6 maintains the turn-on state, the output terminal 1006 and the third input terminal 1003 may maintain electrical connection. When the seventh transistor M7 maintains the turn-on state, the first node N1 and the second input terminal 1002 may maintain electrical connection. The voltage of the second input terminal 1002 may be set to the high level voltage based on an edge of the first clock signal CLK1. As a result, the first node N1 may be set to the high level voltage. When the high level voltage is supplied to the first node N1, the fourth transistor M4 and the fifth transistor M5 may be turned off.

The second clock signal CLK2 may be supplied to the third input terminal 1003. Since the sixth transistor M6 is in a turn on state, the second clock signal CLK2 supplied to the third input terminal 1003 may be supplied to the output terminal 1006. The output terminal 1006 may output the second clock signal CLK2 to the first scan line S11 as the scan signal.

On the other hand, when the second clock signal CLK2 is supplied to the output terminal 1006, the voltage of the second node N2 may descend to a lower level than the second driving power VSS1 by coupling of the first capacitor C1. As a result, the sixth transistor M6 may stably maintain the turn-on state.

Although the voltage of the second node N2 descends, the third node N3 may maintain the voltage of the second driving power VSS1 (voltage of the difference between the second driving VSS1 and the threshold voltage of the first transistor M1) by the first transistor M1.

After the scan signal is output to the first scan line S11, the supply of the second clock signal CLK2 may be discontinued. When the supply of the second clock signal CLK2 is discontinued, the output terminal 1005 may output the high level voltage. In addition, the voltage of the second node N2 may increase to the voltage of the second driving power VSS1 corresponding to the high level voltage of the output terminal 1006.

The first clock signal CLK1 may be supplied. When the first clock signal CLK1 is supplied, the second transistor M2 and the eighth transistor M8 may be turned on. When the second transistor M2 is turned on, the first input terminal 1001 and the third node N3 may be electrically connected to each other. The first start pulse SSP1 is not supplied to the first input terminal 1001. The first input terminal 1001 may be set to the high level voltage accordingly. Therefore, when the first transistor M1 is turned on, the high level voltage may be supplied to the third node N3 and the second node N2. As a result, the sixth transistor M6 and the seventh transistor M7 may be turned off When the eighth transistor M8 is turned on, the second driving power VSS1 may be supplied to the first node N1. As a result, the fourth transistor M4 and the fifth transistor M5 may be turned on. When the fifth transistor M5 is turned on, the voltage of the first driving power VDD1 may be supplied to the output terminal 1006. The fourth transistor M4 and the fifth transistor M5 may maintain the turn-on state based on a voltage charged in the second capacitor C2. As a result, the output terminal 1006 may stably receive the voltage of the first driving power VDD1.

Additionally, when the second clock signal CLK2 is supplied, the third transistor M3 may be turned on. Since the fourth transistor M4 is set to the turn-on state, the first driving power VDD1 may be supplied to the third node N3 and the second node N2. The sixth transistor M6 and the seventh transistor M7 may stably maintain the turn-off state.

The second scan stage circuit SST12 may receive the output signal (scan signal) of the first scan stage circuit SST11 synchronized with the second clock signal CLK2. The second scan stage circuit SST12 may output the scan signal to the first scan line S12 synchronized with the first clock signal CLK1. The scan stage circuits SST may sequentially output the scan signal to the scan lines repeating the above procedure.

On the other hand, the first transistor M1 may limit a fall width of the third node N3 regardless of the voltage of the second node N2. Accordingly, it is possible to reduce manufacturing costs while at the same time achieve improved driving reliability.

Figure 6:
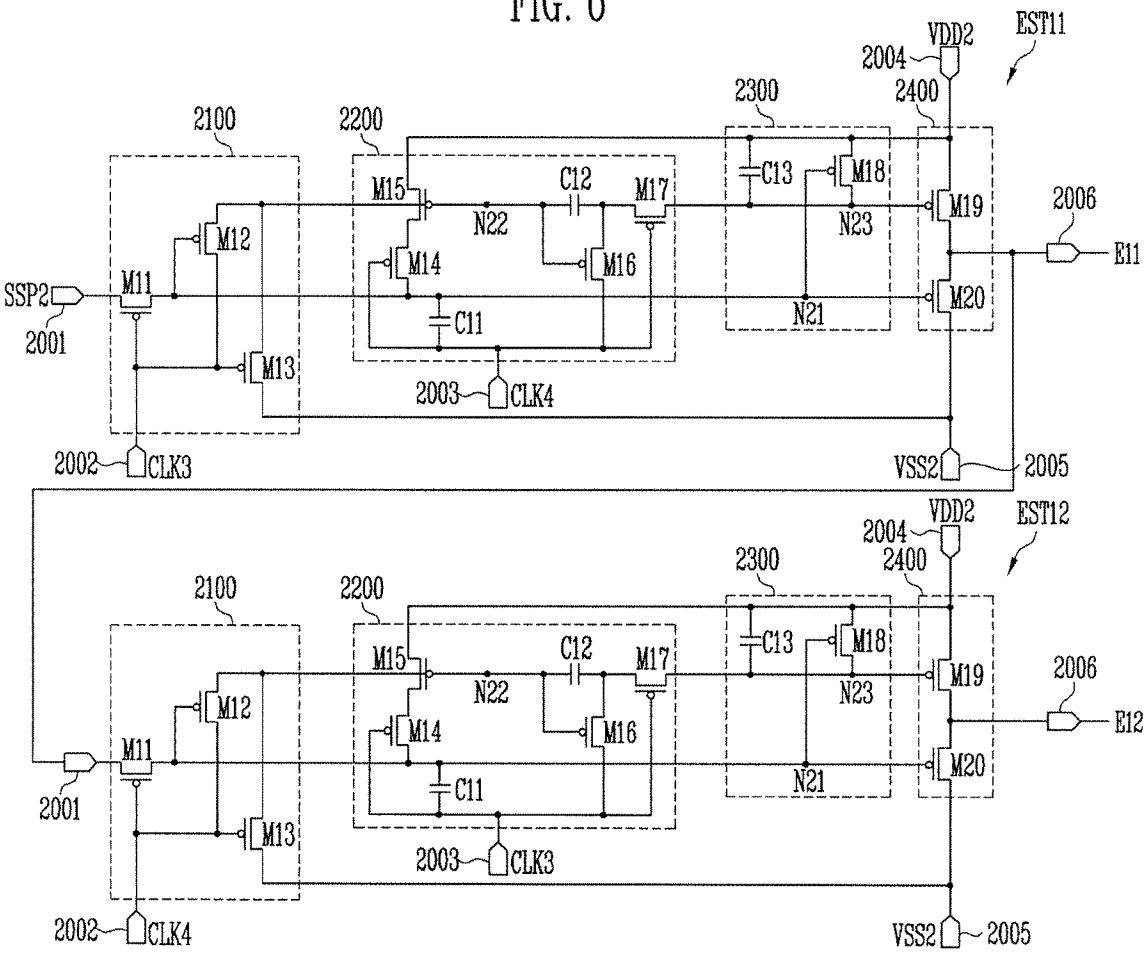
FIG. 6 illustrates an embodiment of a emission stage circuit.

FIG. 6 illustrates an embodiment of a emission stage circuit in FIG. 3. For the convenience of explanation, FIG. 6 illustrates the emission stage circuits EST11 and EST12 of the first sub emission driver 311.

Referring to FIG. 6, the first emission stage circuit EST11 may include a first driving circuit 2100, a second driving circuit 2200, a third driving circuit 2300 and an output unit 2400. The first driving circuit 2100 may control a voltage of a twenty second node N22 and a twenty first node N21 based on signals supplied to a first input terminal 2001 and a second input terminal 2002.

The first driving circuit 2100 may include an eleventh transistor M11 and a thirteenth transistor M13. The eleventh transistor M11 may be connected between the first input terminal 2001 and the twenty first node N21. The gate electrode may be connected to the second input terminal 2002. The eleventh transistor M11 may be turned on when the third clock signal CLK3 is supplied to the second input terminal 2002.

A twelfth transistor M2 may be connected between the second input terminal 2002 and the twenty second node N2. The gate electrode may be connected to the twenty first node N21. The twelfth transistor M12 may be turned on or off based on the voltage of the twenty first node N21.

The thirteenth transistor M13 may be connected between the fifth input terminal 2005 and the twenty second node N22 in which the fourth driving power VSS2 is supplied. The gate electrode may be connected to the second input terminal 2002. Such thirteen transistor M13 may be turned on when the third clock signal CLK3 is supplied to the second input terminal 2002.

The second driving circuit 2200 may control voltage the twenty first node N21 and the twenty third node N23 based on the signal supplied to the third input terminal 2003 and the voltage of the twenty second node N22. To this end, the second driving circuit 2200 may include a fourteenth transistor M14 to a seventeenth transistor M17, an eleventh capacitor C11, and a twelfth capacitor C12.

The fourteenth transistor M14 may be connected between the fifteenth transistor M15 and the twenty first node N21. The gate electrode may be connected to the third input terminal 2003. The fourteenth transistor M14 may be turned on when the fourth clock signal CLK4 is supplied to the third input terminal 2003.

The fifteenth transistor M15 may be connected between the fourth input terminal 2004 that receives the third driving power VDD2 and the fourteenth transistor M14. The gate electrode may be connected to the twenty second node N22. The fifteenth transistor M15 may be turned on or off based on the voltage of twenty second node N22.

A sixteenth transistor M16 may be connected between a first electrode of a seventeenth transistor M17 and the third input terminal 2003. The gate electrode may be connected to the twenty second node N22. The sixteenth transistor M16 may be turned on or off based on the voltage of the twenty second node N22.

The seventeenth transistor M17 may be connected between the a first electrode of the sixteenth transistor M16 and the twenty third node N23. The gate electrode may be connected to the third input terminal 2003. The seventeenth transistor M17 may be turned on when the fourth clock signal CLK4 is supplied to third input terminal 2003.

The eleventh capacitor C11 may be connected between the twenty first node N21 and the third input terminal 2003.

The twelfth capacitor C12 may be connected between the twenty second node N22 and a first electrode of the seventeenth transistor M17.

The third driving circuit 2300 may control a voltage of the twenty third node N23 based on the voltage of the twenty first node N21. The third driving circuit 2300 may include an eighteenth transistor M18 and a thirteenth capacitor C13. The eighteenth transistor M18 may be connected between the fourth input terminal 2004 that receives the third driving power VDD2 and the twenty third node N23 The gate electrode may be connected to the twenty first node N21. The eighteenth transistor 18 may be turned on or off based on the voltage of the twenty first node N21. The thirteenth capacitor C13 may be connected between the fourth input terminal 2004 that receives the third driving power VDD2 and the twenty third node N23.

The output unit 2400 may control the voltage supplied to the output terminal 2006 based on the voltage of the twenty first node N21 and the twenty third node N23. The output unit 2400 may include a nineteenth transistor M19 and a twentieth transistor M20. The nineteenth transistor M19 may be connected between the fourth input terminal 2004 that receives the third driving power VDD2 and the output terminal 2006. The gate electrode may be connected to the twenty third node N23. The nineteenth transistor 19 may be turned on or off based on the voltage of the twenty third node N23.

The twentieth transistor M20 may be connected between the fifth input terminal 2005 that receives the fourth driving power VSS2 and the output terminal 2006. The gate electrode may be connected to the twenty first node N21. The twentieth transistor M20 may be turned on or off corresponding to the voltage of the twenty first node N21. The output unit 2400 may be driven as the buffer.

The nineteenth transistor M19 and/or the twentieth transistor M20 may each be formed of a plurality of transistors connected in parallel. The second emission stage circuit EST12 and the remaining emission stage circuits EST13 and EST1*k* may have the same or similar structure as the first emission stage circuit EST11.

The second input terminal 2002 of a jth emission stage circuit EST1*j* may receive the third clock signal CLK3. The third input terminal 2003 may receive the fourth clock signal CLK4. The second input terminal 2002 of a (j+1)th emission stage circuit EST1*j*+1 may receive the fourth clock signal CLK4. The third input terminal 2003 may receive the third clock signal CLK3.

The third clock signal CLK3 and the fourth clock signal CLK4 may have the same period and the phases thereof do not overlap each other. For example, the first clock signal CLK3 and the second clock signal CLK4 may have the second horizontal period 2H, and be supplied in the different horizontal period from each other FIG. 6 illustrates an embodiment of a stage circuit in the first sub emission driver 311. The stage circuits in the other emission drivers (e.g., second sub emission driver 312, second emission driver 320, and third emission driver 330) in addition to the first sub emission driver 311 may have the same structure.

Figure 7:
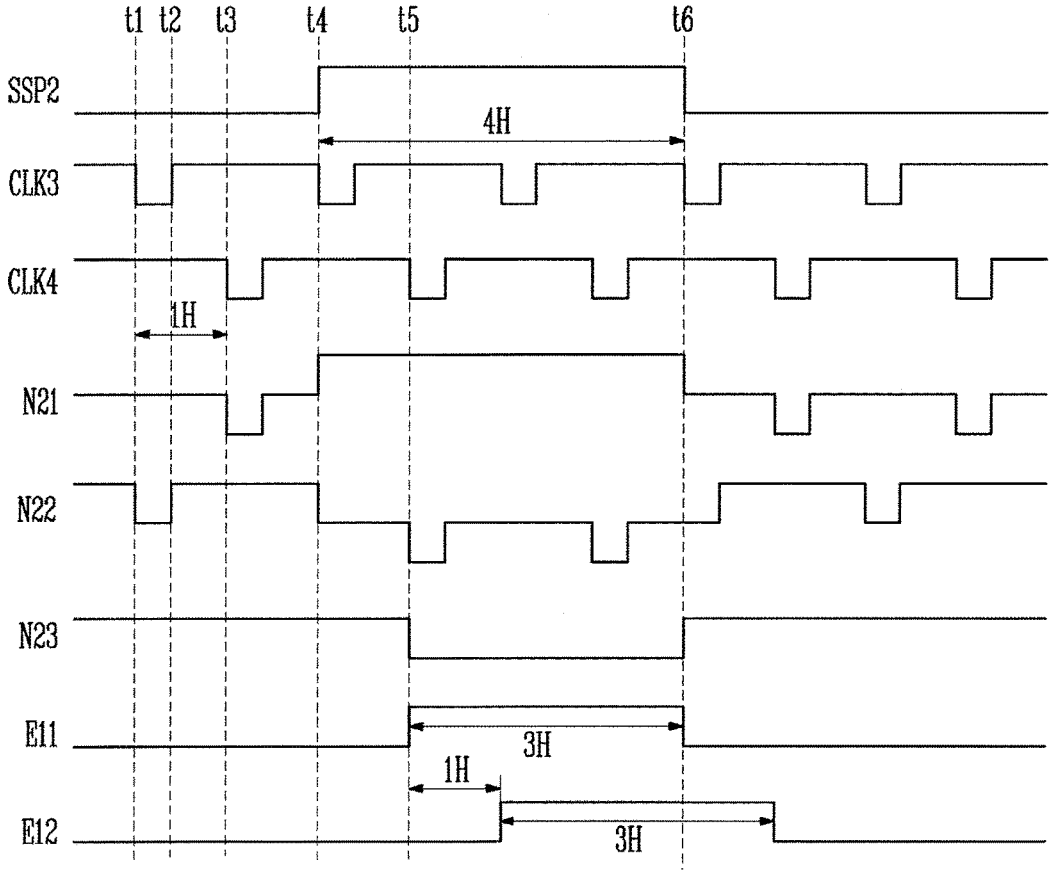
FIG. 7 illustrates an embodiment of a method for driving an emission stage circuit.

FIG. 7 illustrates an embodiment of a method for driving a emission stage circuit in FIG. 6. For the convenience of explanation, the first emission stage circuit EST11 will be exemplified for describing the operation procedure.

Referring to FIG. 7, the third clock signal CLK3 and the fourth clock signal

CLK4 may have the second horizontal period 2H, and be supplied in the different horizontal period from each other. For example, the fourth clock signal CLK4 may be set to the signal shifted by the half period (first horizontal period) from the third clock signal CLK3.

When the second start pulse SSP2 is supplied, the first input terminal 2001 may be set to the voltage of the third driving power VDD2. When the second start pulse SSP2 is not supplied, the first input terminal 2001 may be set to the voltage of the fourth driving power VSS2. Further, when the clock signal CLK is supplied to the second input terminal 2002 and the third input terminal 2003, the second input terminal 2002 and the third input terminal 2003 may be set to the voltage of the fourth driving power VSS2. When the clock signal CLK is not supplied to the second input terminal 2002 and the third input terminal 2003, the second input terminal 2002 and the third input terminal 2003 may be set to the voltage of the third driving power VDD2.

The second start pulse SSP2 supplied to the first input terminal 2001 may be supplied to be synchronized with the clock signal supplied to the second input terminal 2002, which is the third clock signal CLK3. Further, the second start pulse SSP2 may have the wider width than the third clock signal CLK3. The second start pulse SSP2 may be supplied, for example, during a fourth horizontal period 4H.

For example, the third clock signal CLK3 may be supplied to the second input terminal 2002 in the first time t1. When the third clock signal CLK3 is supplied to the second input terminal 2002, the eleventh transistor M11 and the thirteenth transistor M13 may be turned on.

When the eleventh transistor M11 is turned on, the first input terminal 2001 and the twenty first node N21 may be electrically connected to each other. Since the second start pulse SSP2 is not supplied to the first input terminal 2001, the low level voltage may be supplied to the twenty first node N21.

When the low level voltage is supplied to the twenty first node N21, the twelfth transistor M12, the eighteenth transistor M18 and the twentieth transistor M20 may be turned on.

When the eighteenth transistor M18 is turned on, the third driving power VDD2 may be supplied to the twenty third node N23 and the nineteenth transistor M19 may be turned off accordingly.

The thirteenth capacitor C13 may charge the voltage corresponding to the third driving power VDD2. As a result, the nineteenth transistor M19 may stably maintain the turn off state after the first time t1.

When the twentieth transistor M20 is turned on, a voltage of the fourth driving power VSS2 may be supplied to the output terminal 2006. Accordingly, the emission control signal is not supplied to the first emission control line E11 in the first time t1.

When the twelfth transistor M12 is turned on, the third clock signal CLK3 may be supplied to the twenty second node N22. Further, when the thirteenth transistor M13 is turned on, the fourth driving power VSS2 may be supplied to the twenty second node N22. The third clock signal CLK3 may be set to the fourth driving power VSS2. As a result, the twenty second node N22 may be stably set to the voltage of the fourth driving power VSS2. On the other hand, when the voltage of the twenty second node N22 is set to the fourth driving power VSS2, the seventeenth transistor M17 may be set to the turn-off state. Accordingly, the twenty third node N23 may maintain the voltage of the third driving power VDD2 regardless of the voltage of the twenty second node N22.

The supply of the third clock signal CLK3 to the second input terminal 2002 may be discontinued in a second time t2. When the supply of the third clock signal CLK3 is discontinued, the eleventh transistor M11 and the thirteenth transistor M13 may be turned off. The voltage of the twenty first node N21 may maintain the low level voltage by the eleventh capacitor C11. As a result, the twelfth transistor M12, the eighteenth transistor M18 and twentieth transistor M20 may maintain the turn-on state.

When the twelfth transistor M12 is turned on, the second input terminal 2002 and the twenty second node N22 may be electrically connected to each other. The twenty second node N22 may be set to the high level voltage.

When the eighteenth transistor M18 is turned on, the voltage of the third driving power VDD2 may be supplied to the twenty third node N23. As a result, the nineteenth transistor M19 may maintain the turn-off state.

When the twentieth transistor M20 is turned on, the fourth driving power VSS2 may be supplied to the output terminal 2006.

The fourth clock signal CLK4 may be supplied to the third input terminal 2003 in a third time t3. When the fourth clock signal CLK4 is supplied to the third input terminal 2003, the fourteenth transistor M14 and the seventeenth transistor M17 may be turned on.

When the seventeenth transistor M17 is turned on, the twelfth capacitor C12 and the twenty third node N23 may be electrically connected to each other. The twenty third node N23 may maintain the voltage of the third driving power VDD2. Further, when the fourteenth transistor M14 is turned on, the fifteenth transistor M15 is set to the turn-off state. Thus, even though the fourteenth transistor M14 is turned on, the voltage of the twenty first node N21 may be not changed.

When the third input terminal 2003 is supplied to the fourth clock signal CLK4, the twenty first node N21 may descend to the lower level than the fourth driving power VSS2 by coupling of the eleventh capacitor C11. When the voltage of the twenty first node N21 descends to the lower level than the fourth driving power VSS2, driving characteristic of the eighteenth transistor M18 and the twentieth transistor M20 may be improved. (A PMOS transistor may have a more qualified driving characteristic as the lower voltage is applied).

The second start pulse SSP2 may be supplied to the first input terminal 2001 in a fourth time t4, and the third clock signal CLK3 may be supplied to the second input terminal 2002. When the third clock signal CLK3 is supplied to the second input terminal 2002, the eleventh transistor M11 and the thirteenth transistor M13 may be turned on. When the eleventh transistor M11 is turned on, the first input terminal 2001 and the twenty first node N21 may be electrically connected to each other. Since the second start pulse SSP2 is supplied to the first input terminal 2001, the high level voltage may be supplied to the twenty first node N21. When the high level voltage is supplied to the twenty first node N21, the twelfth transistor M12, the eighteenth transistor M18 and the twentieth transistor M20 may be turned off.

The thirteenth transistor M13 is turned on, the voltage of the fourth driving power VSS2 may be supplied to the twenty second node N22. Since the fourteenth transistor M14 is set to the turn-off state, the twenty first node N21 may maintain the high level voltage. Further, since the seventeenth transistor M17 is set to the turn-off state, the voltage of the twenty third node N23 may maintain the high level voltage by the thirteenth capacitor C13. Accordingly, the nineteenth transistor M19 may maintain the turn-off state.

The fourth clock signal CLK4 may be supplied to the third input terminal 2003 in a fifth time t5. When the fourth clock signal CLK4 is supplied to the third input terminal 2003, the fourteenth transistor M14 and the seventeenth transistor M17 may be turned on. Further, since the twenty second node N22 is set to the voltage of the fourth driving power VSS2, the fifteenth transistor M15 and the sixteenth transistor M16 may be turned on.

When the sixteenth transistor M16 and the seventh transistor M7 are turned on, the fourth clock signal CLK4 may be supplied to the twenty third node N23. When the fourth clock signal CLK4 is supplied to the twenty third node N23, the nineteenth transistor M19 may be turned on. When the nineteenth transistor M19 is turned on, the voltage of the third driving power VDD2 may be supplied to the output terminal 2006. The voltage of the third driving power VDD2 supplied to the output terminal 2006 may be supplied to the first emission control line E11 as the emission control signal.

On the other hand, when the fourth clock signal CLK4 is supplied to the twenty third node N23, the voltage of the twenty second node N22 may descend to a lower level than the fourth driving power VSS2 by coupling of the twelfth capacitor C12. Thus, driving characteristics of the transistors connected to the twenty second node N22 may be improved.

When the fourteenth transistor M14 and the fifteenth transistor M15 are turned on, the voltage of the third driving power VDD2 may be supplied to the twenty first node N21. The voltage of the third driving power VDD2 may be supplied to the twenty first node N21 and the twentieth transistor M20 may maintain the turn-off state accordingly. Thus, the voltage of the third driving power VDD2 may be stably supplied to the first emission control line E11.

The third clock signal CLK3 may be supplied to the second input terminal 2002 in a sixth time t6. When the third clock signal CLK3 is supplied to the second input terminal 2002, the eleventh transistor M11 and the thirteenth transistor M13 may be turned on. When the eleventh transistor M11 is turned on, the twenty first node N21 and the first input terminal 2002 may be electrically connected to each other, and the twenty first node N21 may be set to the low level voltage accordingly. When the twenty first node N21 is set to the low level voltage, the eighteenth transistor M18 and the twentieth transistor M20 may be turned on.

When the eighteenth transistor M18 is turned on, the voltage of the third driving power VDD2 may be supplied to the twenty third node N23, and the nineteenth transistor M19 may be turned off accordingly. When the twentieth transistor M20 is turned on, the voltage of the fourth driving power VSS2 may be supplied to the output terminal 2006. The voltage of the fourth driving power VSS2 supplied to the output terminal 2006 may be supplied to the first emission control line E11, and the supply of the emission control signal may be discontinued accordingly.

The emission stage circuits EST may sequentially output the emission control line to the emission control lines repeating the above procedure.

Figure 8:
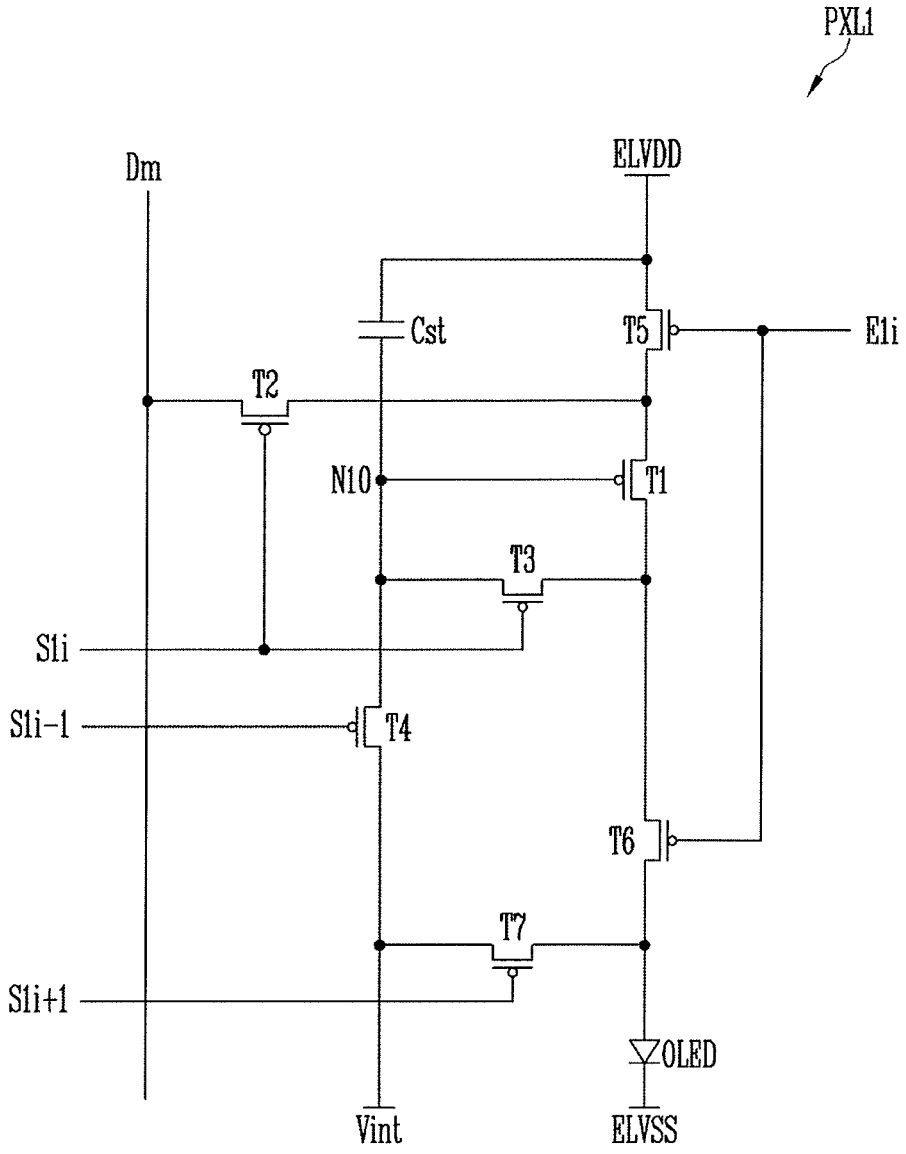
FIG. 8 illustrates an embodiment of a first pixel.

FIG. 8 illustrates an embodiment of a first pixel in FIG. 3. For the convenience of explanation, FIG. 8 illustrates the first pixel PXL1 connected to a mth data line Dm and an ith first scan line S1*i*.

Referring to FIG. 8, the pixel PXL1 may include the organic light emitting diode OLED, the first transistor T1 to the seventh transistor T7 and a storage capacitor Cst.

The organic light emitting diode OLED has an anode connected to the first transistor T1 via a sixth transistor T6 and a cathode connected to the second pixel power ELVSS. Such organic light emitting diode OLED may produce the light with predetermined brightness based on the amount of the current supplied from the first transistor T1.

The first pixel power ELVDD may be set to the higher level voltage than the second pixel power ELVDD, to allow current to flow through the organic light emitting diode OLED.

The seventh transistor T7 may be connected between the reset power Vint and the anode of the organic light emitting diode OLED. The gate electrode of the seventh transistor T7 may be connected to an (i+1)th first scan line S1*i*+1. The seventh transistor T7 may be turned on when the scan signal is supplied to the an (i+1)th first scan line S1*i*+1 and supply the voltage of the reset power Vint to the anode of the organic light emitting diode OLED. The reset power Vint may be set to the lower voltage than the data signal.

The sixth transistor T6 may be connected between the first transistor T1 and the organic light emitting diode OLED. The gate electrode of the sixth transistor T6 may be connected to an ith first emission control line E1*i*. The sixth transistor T6 may be turned off when the emission control signal is supplied to the ith first emission control line E1*i*. In other cases, the sixth transistor T6 may, for example, be turned on.

The fifth transistor T5 may be connected between the first pixel power ELVDD and the first transistor T1. The gate electrode of the fifth transistor T5 may be connected to the ith first emission control line E1*i*. The fifth transistor T5 may be turned off when the emission control signal is supplied to the ith first emission control line E1*i*. In other cases, the sixth transistor T6 may, for example, be turned on.

The first electrode of the first transistor (T1; a driving transistor) may be connected to the first pixel power ELVDD via the fifth transistor T5. The second electrode of the first transistor may be connected to the anode of the organic light emitting diode OLED via the sixth transistor T6. The gate electrode of the first transistor T1 may be connected to a tenth node N10. The first transistor T1 may control the amount of current flowing from the first pixel power ELVDD to the second pixel power ELVSS, via the organic light emitting diode OLED, based on the voltage of the tenth node N10.

The third transistor T3 may be connected between the second electrode of the first transistor T1 and the tenth node N10. The gate electrode of the third transistor T3 may be connected to the ith first scan line S1*i*. When the scan signal is supplied to the ith first scan line S1*i*, the third transistor T3 may be turned on to electrically connect the second electrode of the first transistor T1 to the tenth node N10. When the third transistor T3 is tuned on, the first transistor T1 may be in a diode-connected state.

The fourth transistor T4 may be connected between the tenth node N10 and the reset power Vint. The gate electrode of the fourth transistor T4 may be connected to an (i−1)th first scan line S1*i*−1. The fourth transistor T4 may be turned on when the scan signal is supplied to the (i−1)th first scan line S1*i*−1, and supply the voltage of the reset power Vint to the tenth node N10.

The second transistor T2 may be connected between the mth data line Dm and the first electrode of the first transistor T1. The gate electrode of the second transistor T2 may be connected to the ith first scan line S1*i*. When the scan signal is supplied to the ith first scan line S1*i*, the second transistor T2 may be turned on to electrically connect the mth data line Dm to the first electrode of the first transistor T1.

The storage capacitor Cst may be connected between the first pixel power ELVDD and the tenth node N10. The storage capacitor Cst may store the data signal and a voltage corresponding to a threshold voltage of the first transistor T1.

The second pixel PXL1 and the third pixel PXL2 may have the same circuit structure as the first pixel PXL1. In addition, the pixel structure in FIG. 8 is an example of the scan line and the emission control line. In other embodiments, the pixels PXL1, PXL2 and PXL3 may have a different structure.

According to the present embodiment, the organic light emitting diode OLED may emit a variety of light, such as red, green and blue, based on the amount of current supplied from the driving transistor. In other embodiments, the organic light emitting diode OLED may emit white light based on the amount of current supplied from the driving transistor. In this case, a color image may be created using color filters. Also, the transistor are shown to be PMOS transistors, but one or more of them may be NMOS transistors in another embodiment.

Figure 9:
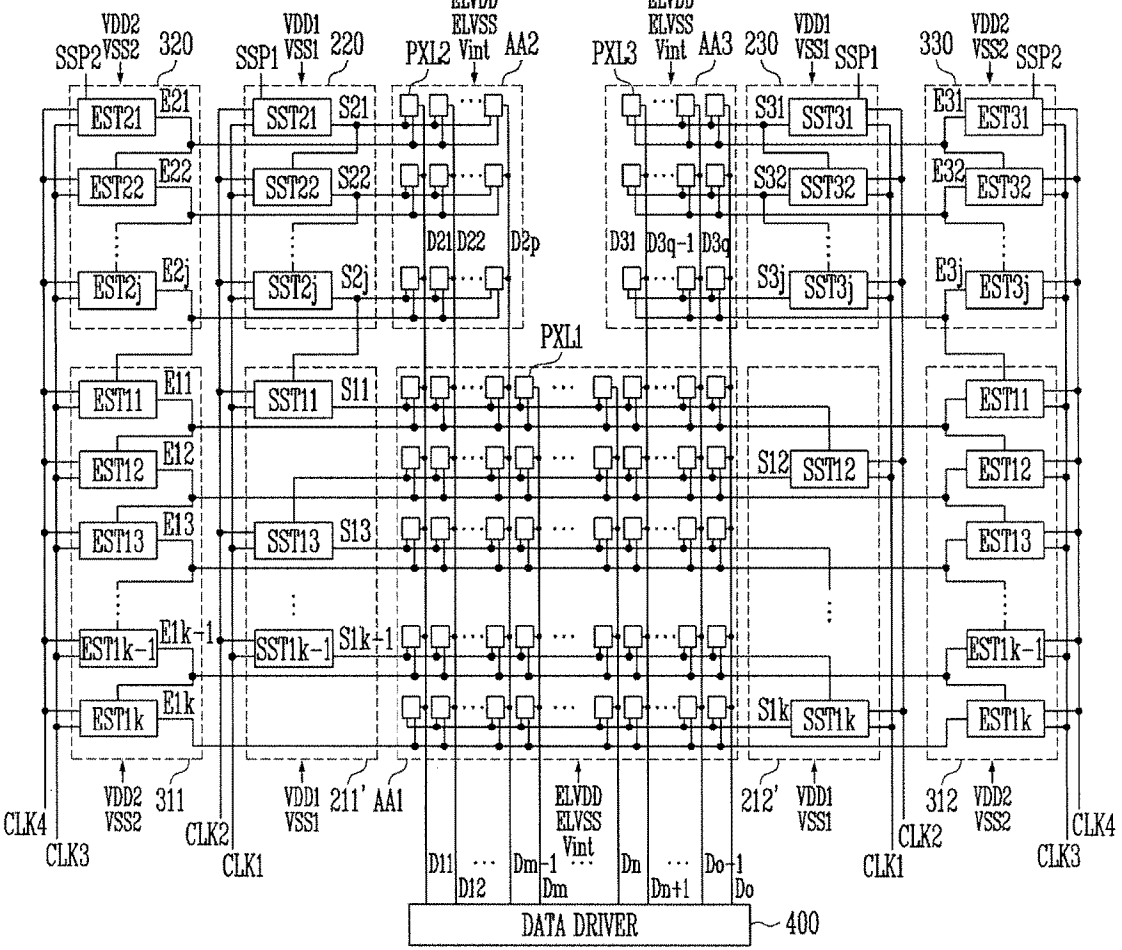
FIG. 9 illustrates an embodiment of a sub scan driver.

FIG. 9 illustrates an embodiment of a sub scan driver which includes a first sub scan driver 211' and a second sub scan driver 212'. The first sub scan driver 211' supplies the first scan signal to a portion of the first scan lines S11 to S1*k* which are first scan lines S11 and S13 to S1*k*−1. The second sub scan driver 212' supplies the first scan signal to a portion of the first scan lines S11 to S1*k* which are first scan lines S12 to S1*k*. For example, the first sub scan driver 211' may supply the first scan signal to the first scan line S11. The second sub scan driver 212' may supply the first scan signal to the second scan line S12. The first sub scan driver 211' and the second sub scan driver 212' may alternately supply the first scan signal to the first scan lines S11 to S1*k*.

The first sub scan driver 211' may include a plurality of scan stage circuits SST11 and SST13 to SST1*k*−1. The scan stage circuits SST11 and SST13 to SST1*k*−1 of the first sub scan driver 211' may supply the first scan signal to a portion of the first scan lines S11 and S13 to S1*k*−1. For example, the scan stage circuits SST11 and SST13 to SST1*k*−1 may supply the first scan signal to an odd-number-th first scan lines S11 and S13 to S1*k*−1. The scan stage circuits SST11 and SST13 to SST1*k*−1 may operate corresponding to the clock signals CLK1 and CLK2 from an external source. The scan stage circuits SST11 and SST13 to SST1*k*−1 may have the same circuit structure.

The scan stage circuits SST11 and SST13 to SST1*k*−1 of the first sub scan driver 211' may receive the output signal (scan signal) of the previous scan stage circuit in the second sub scan driver 212' or the start pulse. For example, the first scan stage circuit SST11 may receive the start pulse. As shown in FIG. 9, the first scan stage circuit SST11 of the first sub scan driver 211' may use the signal output from the last scan stage circuit SST2*j* of the second scan driver 220 as the start pulse.

In another embodiment, the first scan stage circuit SST11 of the first sub scan driver 211' may not receive the signal output from the last scan stage circuit SST2*j* of the second scan driver 220, but may receive a separate start pulse.

The second sub scan driver 212' may include a plurality of scan stage circuits SST12 to SST1*k*. The scan stage circuits SST12 to SST1*k* of the second sub scan driver 212' may supply the first scan signal to another portion of the first scan lines S12 to S1*k*. For example, the scan stage circuits SST12 to SST1*k* may supply the first scan signal to an even-number-th first scan lines S12 to S1*k*. The scan stage circuits SST12 to SST1*k* may operate based on the clock signals CLK1 to CLK2 provided from the external source The scan stage circuits SST12 to SST1*k* may have this same structure.

The scan stage circuits SST12 to SST1*k* of the second sub scan driver 212' may receive the output signal (scan signal) of the previous scan stage circuit in the first sub scan driver 211' or the start pulse. For example, the first scan stage circuit SST12 may receive the start pulse. As shown in FIG. 9, the first scan stage circuit SST12 of the second sub scan driver 212' may receive the signal output from the first scan stage circuit SST11 of the first sub scan driver 211'. In another embodiment, the second scan stage circuit SST12 of the second sub scan driver 212' may not receive the signal output from the first scan stage circuit SST11 of the first sub scan driver 211', but may receive a separate start pulse.

During operation of the first sub scan driver 211' and the second sub scan driver 212', the first scan stage circuit SST11 of the first sub scan driver 211' may output the first scan signal to the first scan signal S11. The first scan stage circuit SST11 of the second sub scan driver 212' may receive the first scan signal from the first scan line S11 and output the first scan signal to the second first scan line S12.

The above procedures may alternately operate, and thus the first scan lines S11 to S1*k* may sequentially receive the first scan signal. In addition, in comparison to the embodiment in FIG. 3, since the number of scan stage circuits in the first sub scan driver 211' and the second sub scan driver 212' is less, respective areas of each of the sub scan driver 211' and 212' may be reduced. Therefore, an area of the first peripheral area NA1 surrounding the first pixel area AA1 may be reduced, and the dead space outside the first pixel area AA1 may be reduced accordingly.

Figure 10:
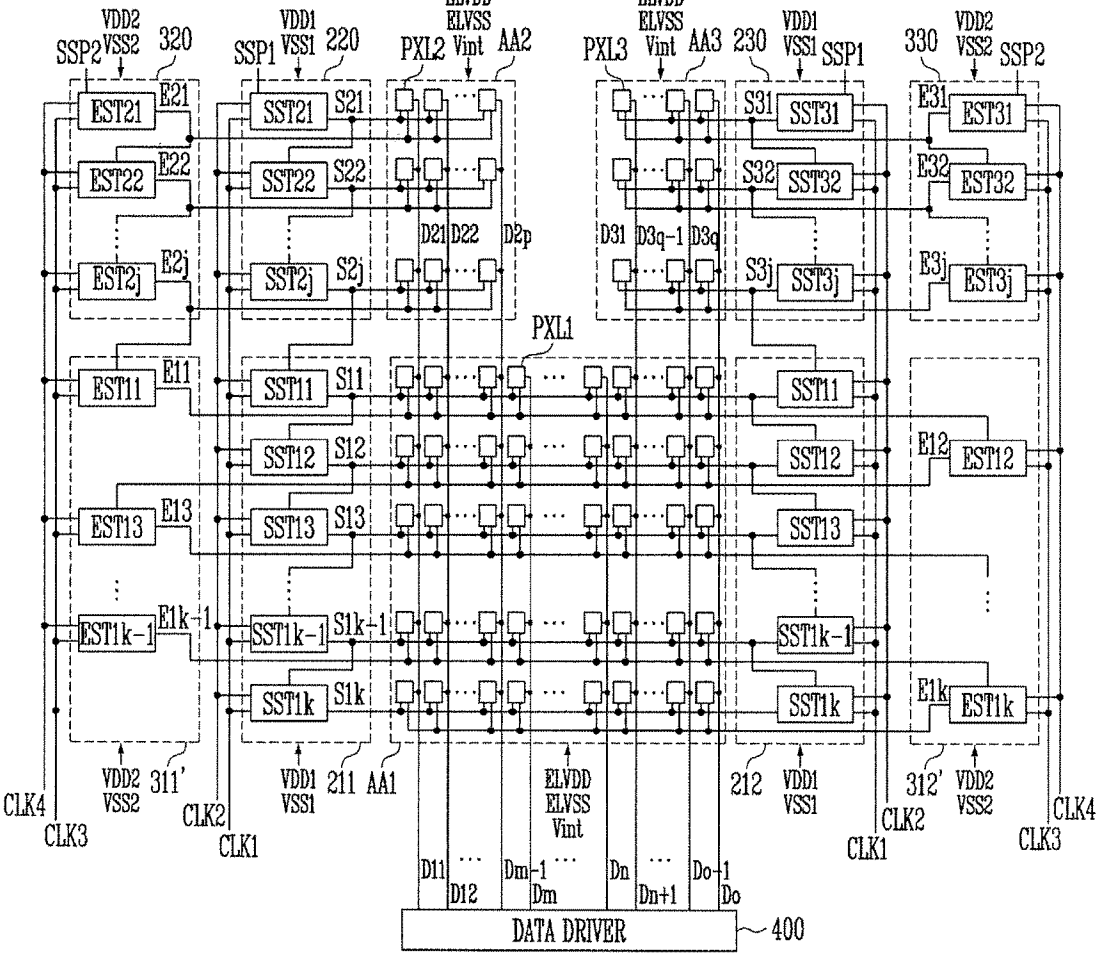
FIG. 10 illustrates an embodiment of a emission driver.

FIG. 10 illustrates an embodiment a emission driver which includes a first sub emission driver 311' and second sub emission driver 312'. The first sub emission driver 311' supplies the first emission control signal to a portion of the first emission lines E11 to E1*k* which are first emission lines E11 and E13 to E1*k*−1. A second sub emission driver 312' supplies the first emission control signal to another portion of the first emission lines E11 to E1*k* which are first emission lines E12 to E1*k*. For example, the first sub emission driver 311' may supply the first emission control signal to the first emission control line E11, and the second sub emission driver 312' may supply the first emission control signal to the second emission control line E12. The first sub emission driver 311' and the second sub emission driver 312' may alternately supply the first emission control signal to the first emission control lines E11 to E1*k*.

The first sub emission driver 311' may include a plurality of emission stage circuits EST11 and EST13 to EST1*k*−1. The emission stage circuits EST11 and EST13 to EST1*k*−1 of the first sub emission driver 211' may supply the first emission control signal to a portion of the first emission control lines E11 and E13 to E1*k*−11. For example, the emission stage circuits EST11 and EST13 to EST1*k*−1 of may supply the first emission control signal to an odd-number-th first emission control lines E11 and E13 to E1*k*−11.

The emission stage circuits EST11 and EST13 to EST1*k*−1 may operate based on the clock signals CLK3 and CLK4 from an external source. The emission stage circuits EST11 and EST13 to EST1*k*−1 may have this same circuit structure.

The emission stage circuits EST11 and EST13 to EST1*k*−1 of the first sub emission driver 311' may receive the output signal (scan signal) of the previous emission stage circuit in the second sub emission driver 312' or the start pulse. For example, the first emission stage circuit EST11 may receive the start pulse. As shown in FIG. 10, the first emission stage circuit EST11 of the first sub emission driver 311' may receive the signal output from the last emission stage circuit EST2*j* of the second sub emission driver 320. In another embodiment, the first emission stage circuit EST11 of the first sub emission driver 311' may not receive the signal output from the last emission stage circuit EST2*j* of the second emission driver 320 and receive the separate start pulse.

The second sub emission driver 312' may include a plurality of emission stage circuits EST12 to EST1*k*. The emission stage circuits EST12 to EST1*k* of the second sub emission driver 312' may supply the first emission control signal to another portion of the first emission control lines E12 to E1*k*. For example, the emission stage circuits EST12 to EST1*k* may supply the first emission control signal to an even-number-th first emission control lines E12 to E1*k*. The emission stage circuits EST12 to EST1*k* may operate corresponding to the clock signals CLK3 and CLK4 from the external source. The emission stage circuits EST12 to EST1*k* may have the same circuit structure.

In another embodiment, the emission stage circuits EST12 to EST1*k* of the second sub emission driver 312' may receive the signal output from the previous emission stage circuit of the second sub emission driver 312' or may receive a separate start pulse. For example, the first emission stage circuit EST12 may receive the start pulse. As shown in FIG. 10, the first emission stage circuit EST12 of the second sub emission driver 312' may receive the signal output from the first emission stage circuit EST11 of the first sub emission driver 311'.

In another embodiment, the second emission stage circuit EST12 of the second sub emission driver 312' may not receive the signal output from the first emission stage circuit EST11 of the first sub emission driver 311', but may receive a separate start pulse.

Referring to the specific operation of the first sub emission driver 311' and the second sub emission driver 312', the first emission stage circuit EST11 of the first sub emission driver 311' may output the first emission control signal to the first emission control line E11. The first emission stage circuit EST11 of the second sub emission driver 312' may receive the first emission control signal output from the first emission control line E11 and output the first emission control signal to the second first emission control line E12. In accordance with the above procedures that alternately operate, the first emission control lines E11 to E1*k* may sequentially receive the first emission control signal.

In comparison to the embodiment in FIG. 3, since the number of emission stage circuits in the second sub emission driver 311' and the second sub emission driver 312' is small, respective areas of the sub emission drivers 311' and 312' may be reduced. Therefore, an area of the first peripheral area NA1 surrounding the first pixel area AA1 may be reduced, dead space outside the first pixel area AA1 may be reduced.

FIGS. 9 and 10 illustrate modified embodiments of sub scan drivers 211' and 212' and the sub emission drivers 311' and 312'. In one embodiment, display device 10 may include sub scan drivers 211' and 212' and sub emission drivers 311' and 312'.

Figure 11:
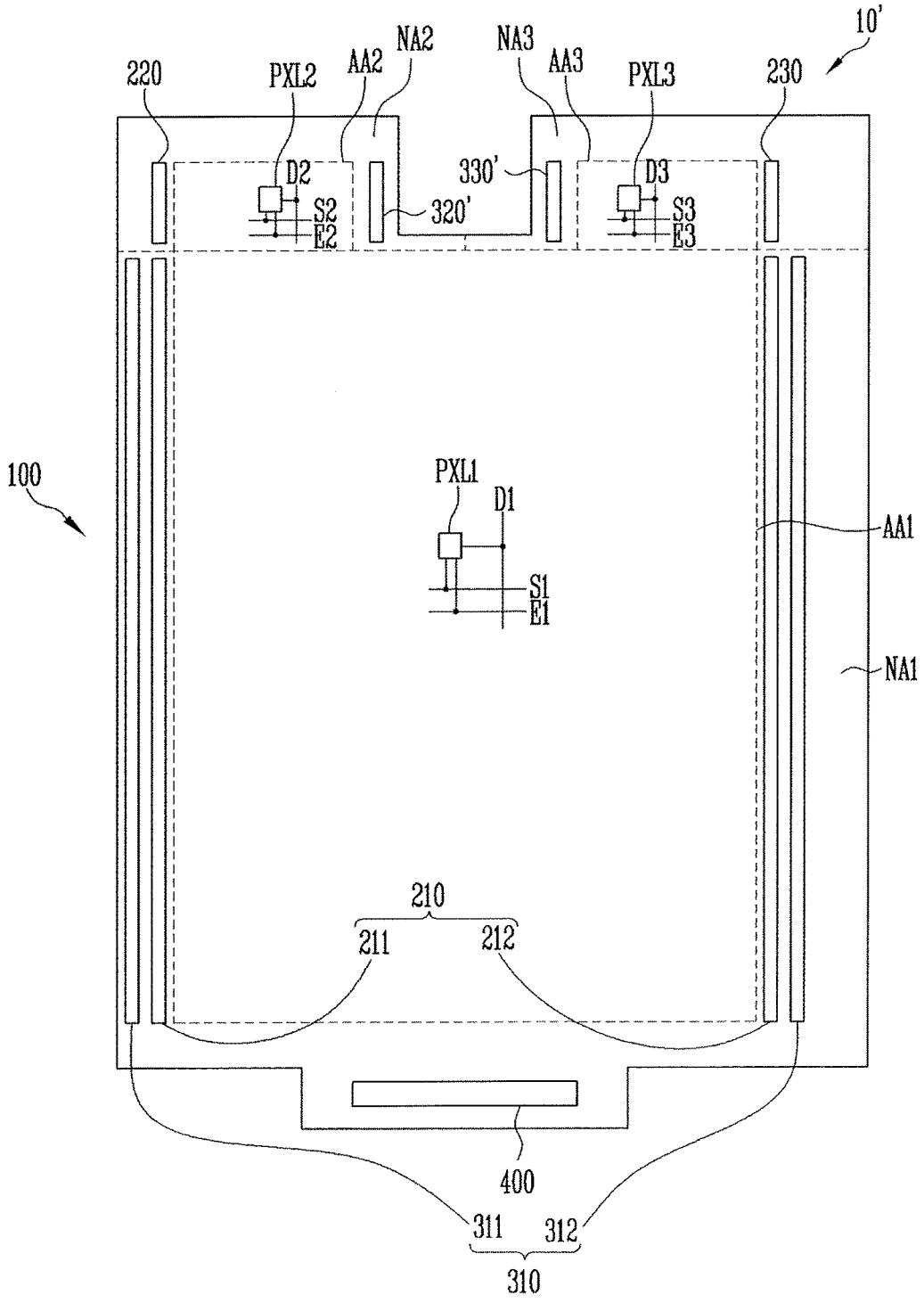
FIG. 11 illustrates an embodiment of a display device.

FIG. 11 illustrating another embodiment of a display device 10'. Compared to the display device 10 in FIG. 2, the positions of a second emission driver 320' and a third emission driver 330' in the display device 10' are different.

When the second scan driver 220 is at one side of the second pixel area AA2 (e.g., left side in FIG. 11), the second emission driver 320' may be at an opposing side of the second pixel area AA2 (e.g., right side in FIG. 11). In addition, when the third scan driver 230 is at one side of the third pixel area AA3 (e.g., right side in FIG. 11), the third emission driver 330' may be at an opposing side of the third pixel area AA3 (e.g., left side in FIG. 11).

In this embodiment, the area of a portion of the second peripheral area NA2 adjacent to the second scan driver 220 may be reduced. Also, the area of a portion of the third peripheral area NA3 adjacent third scan driver 230 may be reduced. Accordingly, dead space at an upper corner of the display device 10' may be reduced or minimized.

The second pixels PXL2 may be between the second scan driver 220 and the second emission driver 320' and receive the second scan signal and the second emission control signal through the second scan line S2 and the second emission control line E2.

In one embodiment, the positions of the second scan driver 220 and the second emission driver 320' may be switched to each other. For example, when the second scan driver 220 is at the other side of the second pixel area AA2 (e.g., right side in FIG. 11), the second emission driver 330' may be at the other opposing side of the second pixel area AA2 (e.g., the left side in FIG. 11).

In addition, positions of the third scan driver 230 and the third emission driver 330' may be switched to each other. For example, when the third scan driver 230 is the other side of the third pixel area AA3 (e.g., left side in FIG. 11), the third emission driver 330' may be at the other opposing side of the third pixel area AA3 (e.g., right side in FIG. 11).

Figure 12:
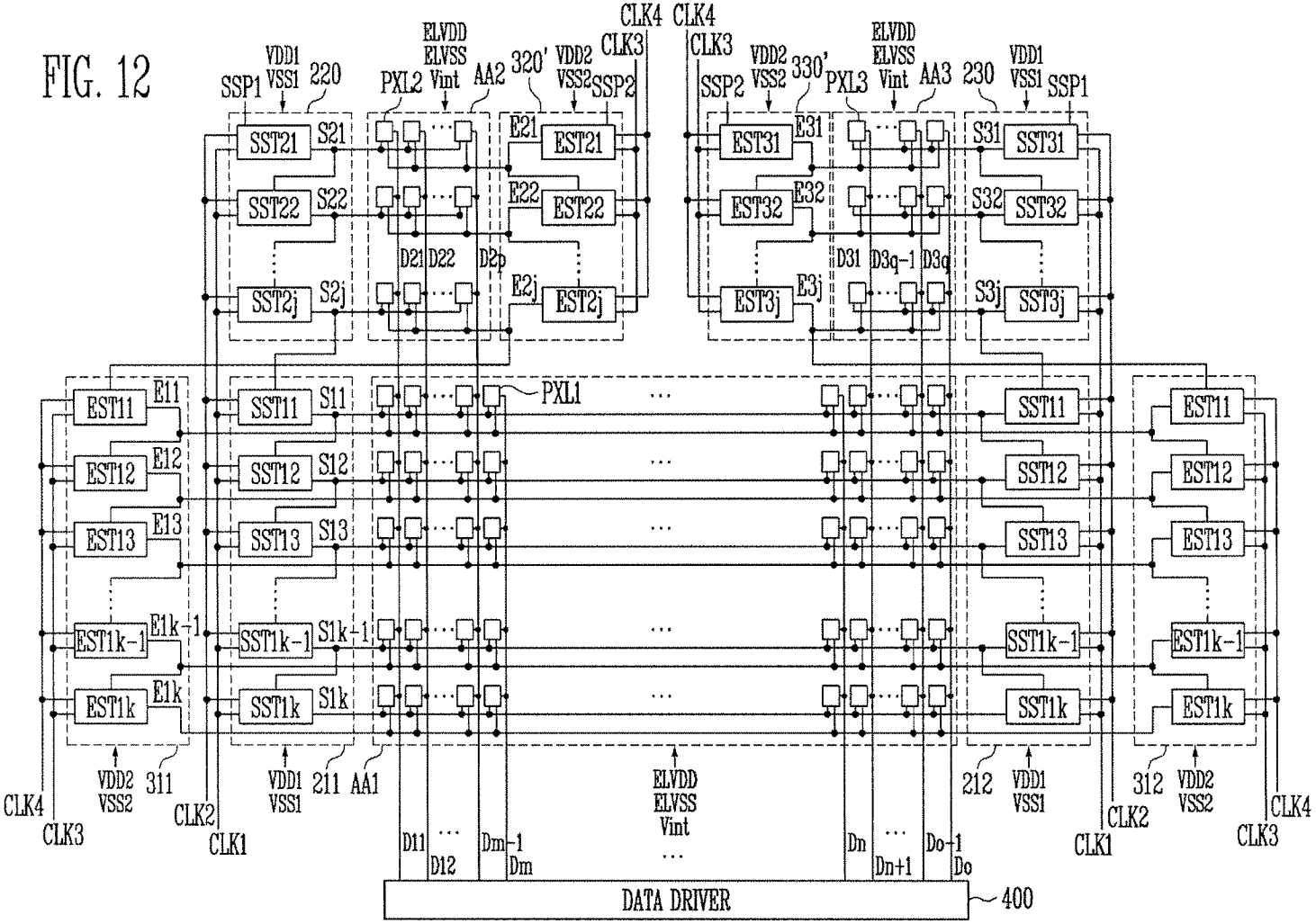
FIG. 12 illustrates another embodiment of a scan driver and a emission driver.

FIG. 12 illustrates an embodiment of a scan driver and a emission driver in FIG. 11, which may correspond to modified embodiments of the second emission driver 320' and the third emission driver 330'. Compared to the above described embodiment, only the position of the second emission driver 320' is changed. The structure and operation thereof may be the same.

The second emission driver 320' may include a plurality of emission stage circuits EST21 to EST2*j*. In accordance with the changed position of the second emission driver 320', the second pixels PXL2 may be between the scan stage circuits SST21 to SST2*j* and the emission stage circuits EST21 to EST2*j*. The last emission stage circuit EST2*j* of the second emission driver 320' may output the output signal to the first emission stage circuit EST11 of the first sub emission driver 311.

Compared to the above described embodiment, only the position of the third emission driver 330' is changed. The structure and operation thereof may be the same.

The third emission driver 330' may include a plurality of emission stage circuits EST31 to EST3*j*. In accordance with the changed position of the third emission driver 330', the third pixels PXL3 may be between the scan stage circuits SST31 to SST3*j* and the emission stage circuits EST31 to EST3*j*. The last emission stage circuit EST3*j* of the third emission driver 330' may output the output signal to the first emission stage circuit EST11 of the second sub emission driver 312.

Figure 13:
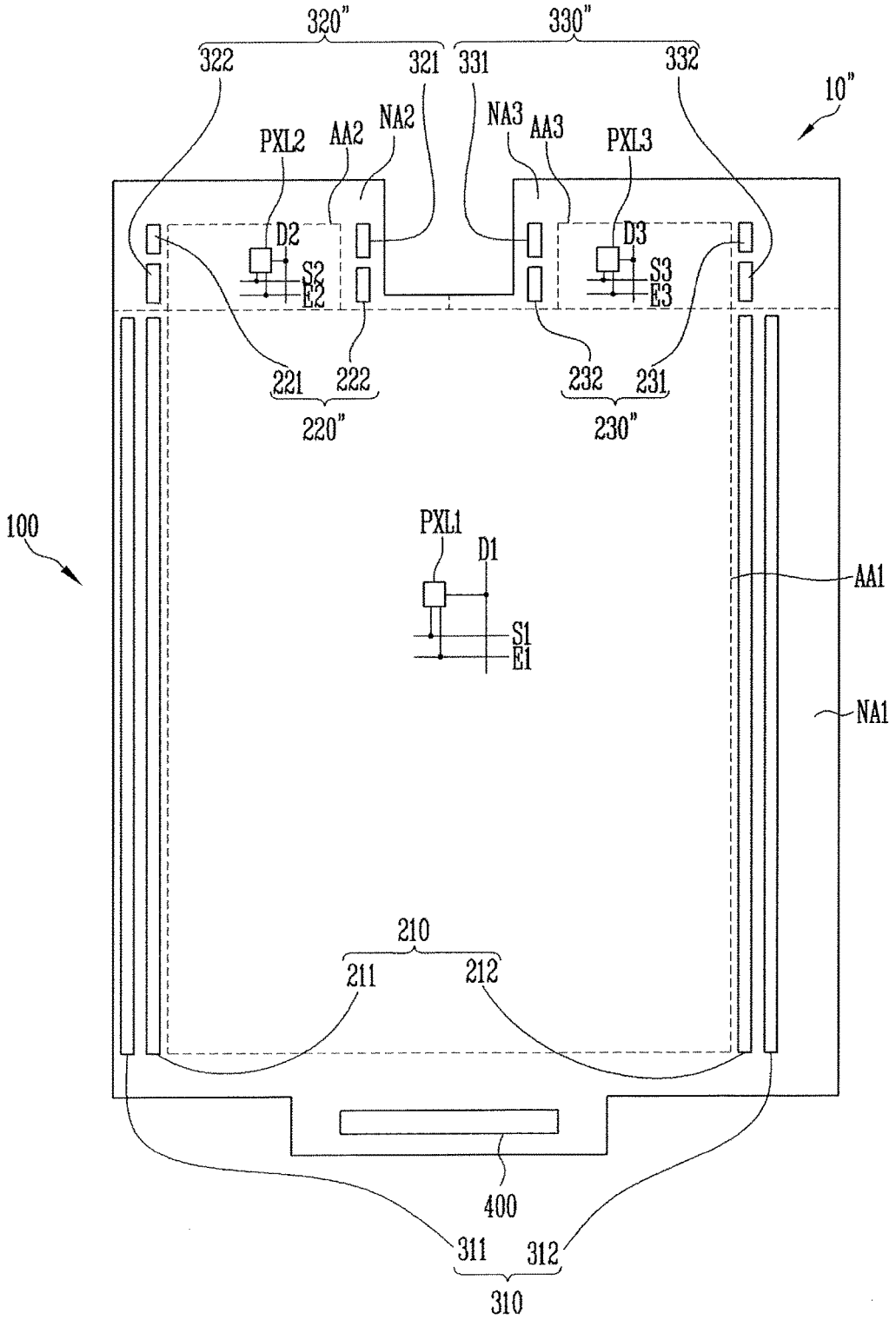
FIG. 13 illustrates another embodiment of a display device.

FIG. 13 illustrates another embodiment of a display device 10" which includes a second scan driver 220" and a second emission driver 320" separated into multiple bodies and arranged at different sides of the second pixel area AA2.

The second scan driver 220" may include, for example, a third sub scan driver 221 and a fourth sub scan driver 222. The third sub scan driver 221 may be at one side of the second pixel area AA2 (e.g., left side in FIG. 13) to supply the second scan signal to the portion of the second scan lines S2. The fourth sub scan driver 222 may be at the opposing side of the second pixel area AA2 (e.g., right side in FIG. 13) to supply the second scan signal to the portion of the second scan lines S2.

The second emission driver 320" may include, for example, a third sub emission driver 321 and a fourth sub emission driver 322. The third sub emission driver 321 may be at the other side of the second pixel area AA2 (e.g., right side in FIG. 13) to supply the second emission control signal to the portion of the second emission lines E2. The fourth emission driver 322 is at the other side of the second pixel area AA2 (e.g., the left side in FIG. 13) to supply the second emission control signal to another portion of the second emission control lines E2.

The third sub scan driver 221 and the fourth sub emission driver 322 may be at one side of the second pixel area AA2 (e.g., left side in FIG. 13), the third sub emission driver 321 and the fourth sub scan driver 222 may be at the other opposing side of the second pixel area AA2 (e.g., right side in FIG. 13).

The third scan driver 230" and the third emission driver 330" may be separated into multiple bodies and different sides of the third pixel area AA3.

The third scan driver 230" may include, for example, a fifth sub scan driver 231 and a sixth sub scan driver 232. The fifth sub scan driver 231 may be at one side of the third pixel area AA3 (e.g., right side in FIG. 13) to supply the third scan signal to the portion of the third scan lines S3. The sixth sub scan driver 232 may be at an opposing side of the third pixel area AA3 (e.g., left side in FIG. 13) to supply the third scan signal to a portion of the third scan lines S3.

The third emission driver 330" may include, for example, a fifth sub emission driver 331 and a sixth sub emission driver 332. The fifth sub emission driver 331 may be at the other side of the third pixel area AA3 (e.g., left side in FIG. 13) to supply the third emission control signal to a portion of the third emission control lines E3. The sixth sub emission driver 332 may be at an opposing side of the second pixel area AA2 (e.g., right side in FIG. 13) to supply the third emission control signal to another portion of the third emission control lines E3.

The fifth sub scan driver 231 and the sixth sub emission driver 332 may be at one side of the third pixel area AA2 (e.g., right side in FIG. 13), the fifth sub emission driver 321 and the sixth sub scan driver 232 may be at an opposing side of the third pixel area AA3 (e.g., left side in FIG. 13).

Figure 14:
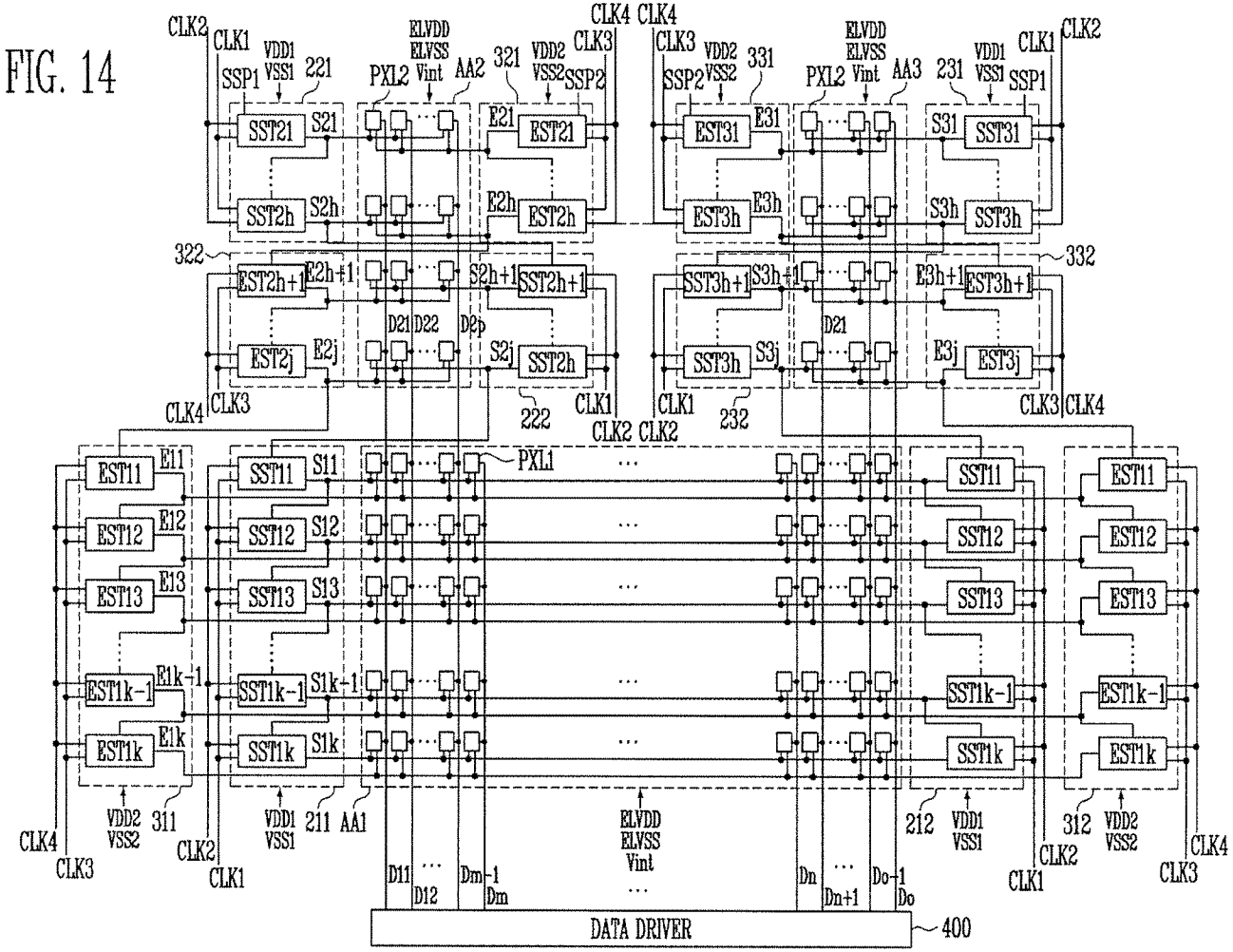
FIG. 14 illustrates another embodiment of a scan driver and a emission driver.

FIG. 14 illustrates an embodiment of a scan driver and a emission driver in FIG. 13. For example, FIG. 14 illustrates modified embodiments of the second scan driver, the third scan driver, the second emission driver, and the third emission driver. The third sub scan driver 221 may supply the second scan signal to a portion of the second scan lines S21 to S2*j*, which are the second scan lines S21 to S2*h*.

The third sub scan driver 221 may include, for example, a plurality of scan stage circuits SST21 to SST2*h*. The scan stage circuits SST21 to SST2*h* may be connected to one side of the portion of the second scan lines S21 to S2*h* to supply the second scan signal to the portion of the second scan lines S21 to S2*h*, respectively. The scan stage circuits SST21 to SST2*h* may operate based on clock signals CLK1 and CLK2 from the external source. The scans stage circuits SST21 to SST2*h* may have the same structure.

The scan stage circuits SST21 to SST2*h* of the third sub scan driver 221 may receive the output signal (scan signal) of the previous scan stage circuit or the start pulse. For example, the first scan stage circuit SST21 may receive the start pulse SSP1 and remaining scan stage circuits SST21 to SST2*h* may receive the output signal of the previous stage circuit. The last scan stage circuit SST2*h* of the third sub scan driver 221 may supply the output signal to the first scan stage circuit SST2*h*+1 of the fourth sub scan driver 222. The fourth sub scan driver 222 may supply the second scan signal to another portion of the second sub scan lines S2*h*+1 to S2*j*, which are the second scan lines S2*h*+1 to S2*j*.

The fourth sub scan driver 222 may include, for example, a plurality of scan stage circuits SST2*h*+1~SST2*j*. The scan stage circuits SST2*h*+1 to SST2*j* may be connected to one side of another portion of the second scan lines S2*h*+1 to S2*j* to supply the second scan signal to another portion of second scan lines S2*h*+1 to S2*j*, respectively. The scan stage circuits SST2*h*+1 to SST2*j* may operate based on clock signals CLK1 and CLK2 from an external source. The scan stage circuits SST2*h*+1 to SST2*j* have the same circuit structure.

The scan stage circuits SST2*h*+1 to SST2*j* of the fourth sub scan driver 222 may receive the output signal (scan signal) of the previous scan stage circuit or the start pulse. For example, the first scan stage circuit SST2*h*+1 may receive the start pulse and remaining scan stage circuits SST2*h*+2 to SST2*j* may receive the output signal of the previous stage circuit.

As shown in FIG. 14, the first scan stage circuit SST2*h*+1 of the fourth sub scan driver 222 may use the signal output from the last scan stage circuit SST2*h* of the third sub scan driver 221 as the start pulse. In another embodiment, the first scan stage circuit SST2*h*+1 of the fourth sub scan driver 222 may not receive the signal output from the last scan stage circuit SST2*h* of the third sub scan driver 221, but may receive a separate start pulse.

The third sub emission driver 321 may supply the second emission control signal to a portion of the second emission control lines E21 to E2*j*, which are the second emission control lines E21 to E2*h*.

The third sub emission driver 321 may include, for example, a plurality of emission stage circuits EST21 to EST2*h*. The emission stage circuits EST21 to EST2*h* may be connected to one side of a portion of the second emission control lines E21 to E2*h* and supply the second emission control signal to a portion of the second emission control lines E21 to E2*h*, respectively. The emission stage circuits EST21 to EST2*h* may operate based on the clock signals CLK3 and CLK4 from the external source. The emission stage circuits EST21 to EST2*h* may have the same circuit structure.

The emission stage circuits EST21 to EST2*h* of the third sub emission driver 321 may receive the output signal (emission control signal) of the previous emission stage circuit or the start pulse. For example, the first emission stage circuit EST21 may receive the start pulse SSP2 and other or remaining ones of emission stage circuits EST21 to EST2*h* may receive the output signal of the previous stage circuit. The last emission stage circuit EST2*h* of the third sub emission driver 321 may supply the output signal to the first emission stage circuit EST2*h*+1 of the fourth sub emission driver 322.

The fourth sub emission driver 322 may supply the second emission control signal to another portion of the second emission control lines E21 to E2*j*, which are the second emission control lines E2*h*+1 to E2*j*.

The fourth sub emission driver 322 may include, for example, a plurality of emission stage circuits EST2*h*+1 to EST2*j*. The emission stage circuits EST2*h*+1 to EST2*j* may be connected to one side of another portion of the second emission control lines E2*h*+1 to E2*j* and supply the second emission control signal to another portion of the second emission control lines E2*h*+1 to E2*j*, respectively.

The emission stage circuits EST2*h*+1 to EST2*j* may operate based on the clock signals CLK3 and CLK4 from a external source. The emission stage circuits EST2*h*+1 to EST2*j* may have the same circuit structure.

The emission stage circuits EST2*h*+1 to EST2*j* of the fourth sub emission driver 322 may receive the output signal (that is, the emission control signal) of the previous emission stage circuit or the start pulse. For example, the first emission stage circuit EST2*h*+1 may receive the start pulse and remaining scan stage circuits EST2*h*+2 to EST2*j* may receive the output signal of the previous stage circuit.

As shown in FIG. 14, the first scan stage circuit EST2*h*+1 of the fourth sub emission driver 322 may use the signal output from the last scan stage circuit EST2*h* of the third sub emission driver 321 as the start pulse. In another embodiment, the first emission stage circuit EST2*h*+1 of the fourth sub emission driver 322 may not receive the signal output from the last emission stage circuit EST2*h* of the third sub emission driver 321, but may receive a separate start pulse.

The fifth sub scan driver 231 may supply the third scan signal to a portion of the third scan lines S31 to S3*j*, which are the third scan lines S31 to S3*h*.

The fifth sub scan driver 231 may include, for example, a plurality of scan stage circuits SST31 to SST3*h*. The scan stage circuits SST31 to SST3*h* may be connected to one side of the portion of the third scan lines S31 to S3*h* to supply the third scan signal to the portion of the third scan lines S31 to S3*h*, respectively. The scan stage circuits SST31 to SST3*h* may operate based on the clock signals CLK1 and CLK2 from an external source. The scan stage circuits SST31 to SST3*h* may have the same circuit structure.

The scan stage circuits SST31 to SST3*h* of the fifth sub scan driver 231 may receive the output signal (scan signal) of the previous scan stage circuit or the start pulse SSP1.

The first scan stage circuit SST31 may receive, for example, the start pulse SSP1 and other or remaining ones of scan stage circuits SST31 to SST3*h* may receive the output signal of the previous stage circuit. The last scan stage circuit SST3*h* of the fifth sub scan driver 231 may supply the output signal to the first scan stage circuit SST3*h*+1 of the sixth sub scan driver 232. The sixth sub scan driver 232 may supply the third scan signal to another portion of the third scan liens S31 to S3*j*, which are the third scan lines S3*h*+1 to S3*j*.

The sixth sub scan driver 232 may include, for example, a plurality of scan stage circuits SST3*h*+1 to SST3*j*. The scan stage circuits SST3*h*+1 to SST3*j* may be connected to one side of another portion of the third scan lines S3*h*+1 to S3*j* to supply the third scan signal to another portion of the third scan lines S3*h*+1 to S3*j*, respectively.

The scan stage circuits SST3*h*+1 to SST3*j* may operate based on the clock signals CLK1 and CLK2 from a external source. The scan stage circuits SST3*h*+1 to SST3*j* may have the same circuit structure.

The scan stage circuits SST3*h*+1 to SST3*j* of the sixth sub scan driver 232 may receive the output signal (scan signal) of the previous scan stage circuit or the start pulse. For example, the first scan stage circuit SST3*h*+1 may receive the start pulse and remaining stage circuits SST3*h*+2 to SST3*j* may receive the output signal of the previous stage circuit.

As shown in FIG. 14, the first scan stage circuit SST3*h*+1 of the sixth sub scan driver 232 may use the signal output from the last scan stage circuit SST3*h* of the fifth sub scan driver 231 as the start pulse. In another embodiment, the first scan stage circuit SST3*h*+1 of the sixth sub scan driver 232 may not receive the signal from the last scan stage circuit SST3*h* of fifth sub scan driver 231, but may receive a separate start pulse.

The fifth sub emission driver 331 may supply the third emission control signal to the portion of the third emission control lines E31 to E3*j*, which are the third emission control lines E31 to E3*h*.

The fifth sub emission driver 331 may include, for example, a plurality of emission stage circuits EST31 to EST3*h*. The emission stage circuits EST31 to EST3*h* may be connected to one side of the portion of the third emission control liens E31 to E3*h*, and supply the third emission control signal to the portion of the third emission control liens E31 to E3*h*, respectively. The emission stage circuits EST31 to EST3*h* may operate based on the clock signals CLK3 and CLK4 from a external source. The emission stage circuits EST31 to EST3*h* may have the same circuit structure.

The emission stage circuits EST31 to EST3*h* of the fifth sub emission driver 331 may receive the output signal (emission control signal) of the previous emission stage circuit or the start pulse. For example, the first emission stage circuit EST31 may receive the start pulse SSP2 and other and remaining ones of scan stage circuits EST31 to EST3*h* may receive the output signal of the previous stage circuit. The last emission stage circuit EST3*h* of the fifth sub emission driver 331 may supply the output signal to the first emission stage circuit EST3*h*+1 of the sixth sub emission driver 332.

The sixth sub emission driver 332 may supply the third emission control signal to the portion of the third emission control lines E31 to E3*j*, which are the third emission control lines E3*h*+1 to E3*j*.

The sixth sub emission driver 332 may include, for example, a plurality of emission stage circuits EST3*h*+1 to EST3*j*. The emission stage circuits EST3*h*+1 to EST3*j* may be connected to one side of another portion of the third emission control lines E3*h*+1 to E3*j* and supply the third emission control signal to another portion of the third emission control lines E3*h*+1 to E3*j*, respectively. The emission stage circuits EST3*h*+1 to EST3*j* may operate based on clock signals CLK3 and CLK4 from a external source. Emission stage circuits EST3*h*+1 to EST3*j* may have the same circuit structure.

The emission stage circuits EST3*h*+1 to EST3*j* of the sixth sub emission driver 332 may receive the output signal (emission control signal) of the previous emission stage circuit or the start pulse. For example, the first emission stage circuit EST3*h*+1 may receive the start pulse and remaining scan stage circuits EST3*h*+2 to EST3*j* may receive the output signal of the previous stage circuit.

As shown in FIG. 14, the first emission stage circuit EST3*h*+1 of the sixth sub emission driver 332 may use the signal output from the last emission stage circuit EST3*h* of the fifth sub emission driver 331 as the start pulse. In another embodiment, the first emission stage circuit EST3*h*+1 of the sixth sub emission driver 332 may not receive the signal output from the last emission stage circuit EST3*h* of the fifth sub emission driver 331, but may receive a separate start pulse.

Figure 15:
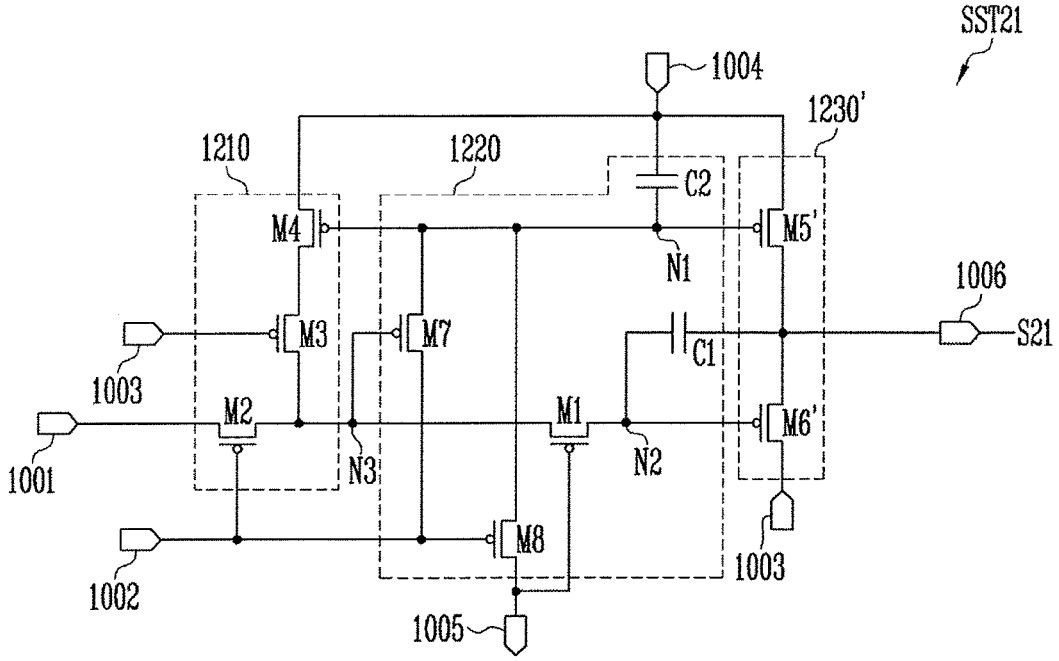
FIG. 15 illustrates an embodiment of a scan stage circuit of a first scan driver and a second scan driver.
Figure 15:
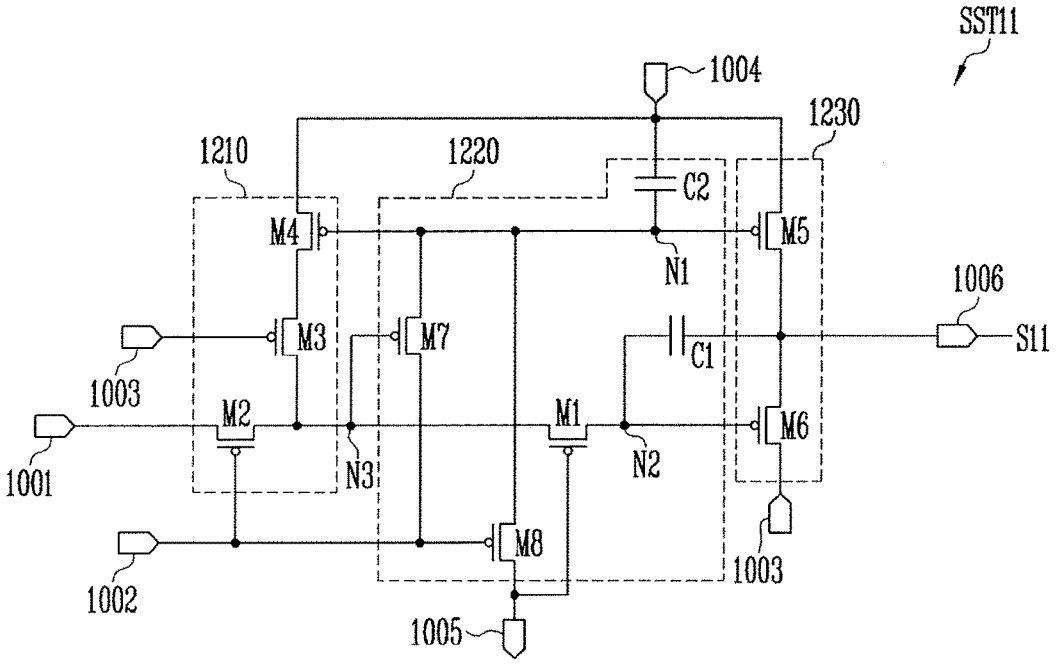

FIG. 15 illustrates another embodiment of a scan stage circuit of a first scan driver and a second scan driver in FIG. 3. For the convenience of explanation, FIG. 15 illustrates the scan stage circuit SST11 of the first sub scan driver 211 and the scan stage circuit SST21 of the second scan driver 220. In addition, for convenience of explanation, the scan stage circuit SST11 of the first sub scan driver 211 will be indicated as the first scan stage circuit SST11 and the scan stage circuit SST21 of the second scan driver 220 will be indicated as the second scan stage circuit SST21.

Since the area of the second pixel area AA2 is set to be smaller than the first pixel area AA1, brightness deviation caused by a load difference may arise in the first pixel r area AA1 and in the second pixel area AA2. In order to reduce the brightness deviation, the size of the at least one transistor in each scan stage circuit may be different in accordance with the load difference. For example, at least one transistor of the transistors M1 to M8 in the second scan stage circuit SST21 may be smaller than the transistors M1 to M8 in the first scan stage circuit SST1.

In one embodiment, the above may be applied to the output unit 1230 and 1230' directly related to the output signal. For example, respective areas of the transistors M5' and M6' in the output unit 1230' of the second scan stage circuit SST21 may smaller than those of the transistors M5 and M6 in the output unit 1230 of the first scan stage circuit SST11. To this end, a ratio (W/L) of the width to the length of the channel of each transistor may be controlled. For example, the ratio (W/L) of the width to the length of the channel of the transistors M5' and M6 in the second scan stage circuit SST21 may be smaller than ratio (W/L) of the width to the length of the channel of the transistors M5 and M6 in the first scan stage circuit SST11.

The first scan driver 210 and the second scan driver 220 are exemplified. However, the above may be applied to the first scan driver 210 and the third scan driver 230 in the same manner. Since respective sizes of transistors in the second scan driver 220 and the third scan driver 230 are reduced, dead space at the upper corner of the display device 10 may be reduced or minimized.

Figure 16:
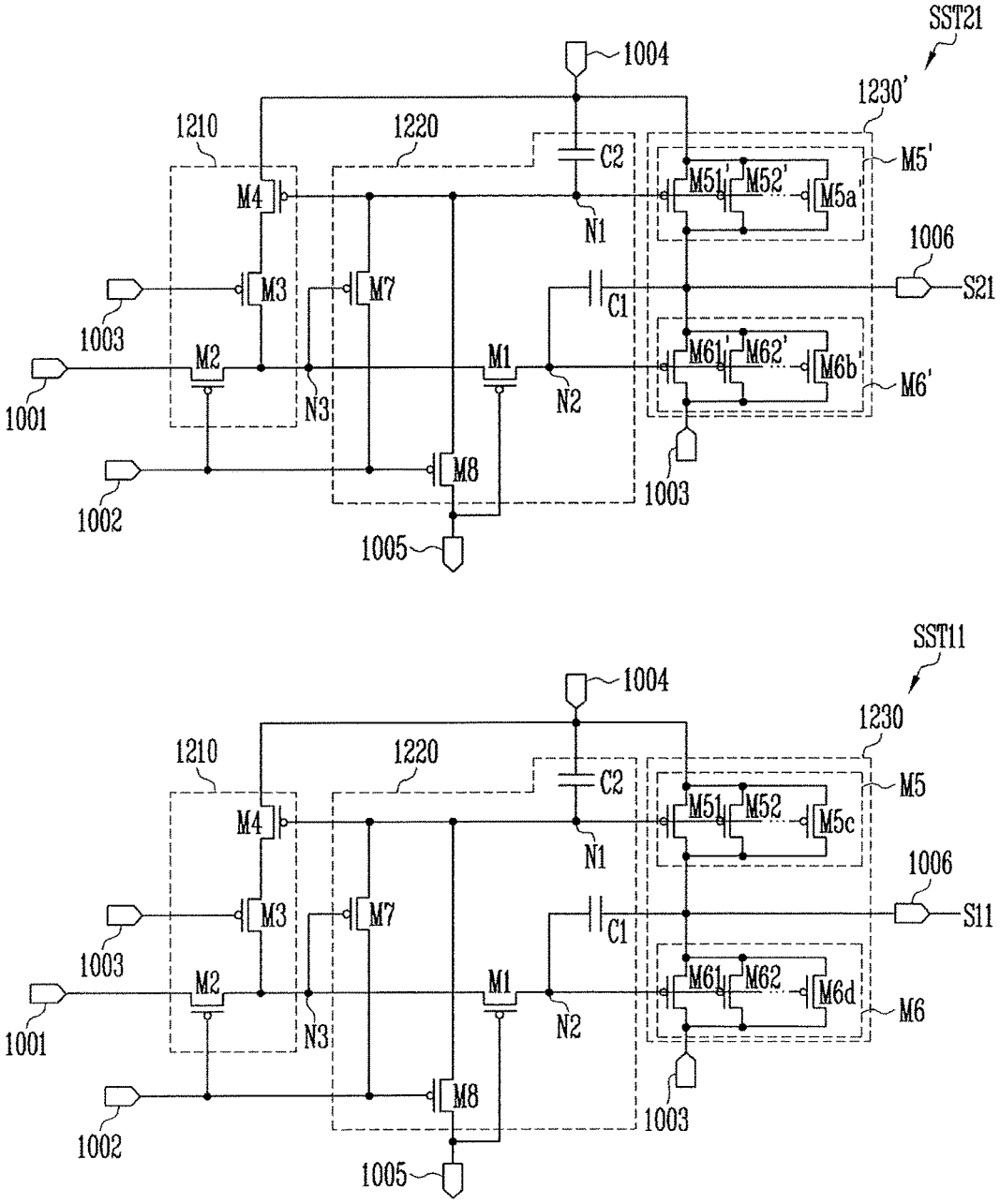
FIG. 16 illustrates another embodiment of a scan stage circuit of a first scan driver and a second scan driver.

FIG. 16 illustrates another embodiment of a scan stage circuit of a first scan driver and a second scan driver in FIG. 3. For the convenience of explanation, FIG. 16 illustrates the scan stage circuit SST11 of the first sub scan driver 211 and the scan stage circuit SST21 of the second scan driver 220. In addition, for convenience of explanation, the scan stage circuit SST11 of the first sub scan driver 211 will be indicated as the first scan stage circuit SST11 and the scan stage circuit SST21 of the second scan driver 220 will be indicated as the second scan stage circuit SST21.

Each of the transistors M5' and M6' in the output unit 1230' of the second scan stage circuit SST21 may include a plurality of auxiliary transistors connected in parallel. For example, a fifth transistor M5' of the second scan stage circuit SST21 may include first auxiliary transistors M51' to M5*a*'. A sixth transistor M6' of the second scan stage circuit SST21 may include second auxiliary transistors M61' to M6*a*'.

Each of the transistors M5 and M6 in the output unit 1230 of the first scan stage circuit SST11 may include a plurality of auxiliary transistors connected in parallel. For example, the fifth transistor M5 of the first scan stage circuit SST11 may include third auxiliary transistors M51 to M5*c*. The sixth transistor M6 of the first scan stage circuit SST11 may include fourth auxiliary transistors M61 to M6*d*.

To control the size of each transistor M5', M6', M5, and M6, the number of auxiliary transistors in each of the transistors M5', M6', M5, and M6 may be differently determined. For example, the number of first auxiliary transistors M51' to M5*a*' may be less than the number of third auxiliary transistors M51 to M5*c*. The number of second auxiliary transistors M61' to M6*b*' may be less than the number of fourth auxiliary transistors M61 to M6*d*.

For example, ratios(W/L) of widths to lengths of channels of the first auxiliary transistors M51' to M5*a*' may be the same as one another, and ratios(W/L) of widths to lengths of channels of the second auxiliary transistors M61' to M6*b*' may be the same as one another. In addition, the ratios(W/L) of the widths to the lengths of the channels of the first auxiliary transistors M51' to M5*a*' may be the same as the ratios(W/L) of the widths to the lengths of the channels of the second auxiliary transistors M61' to M6*b*'.

Figure 17:
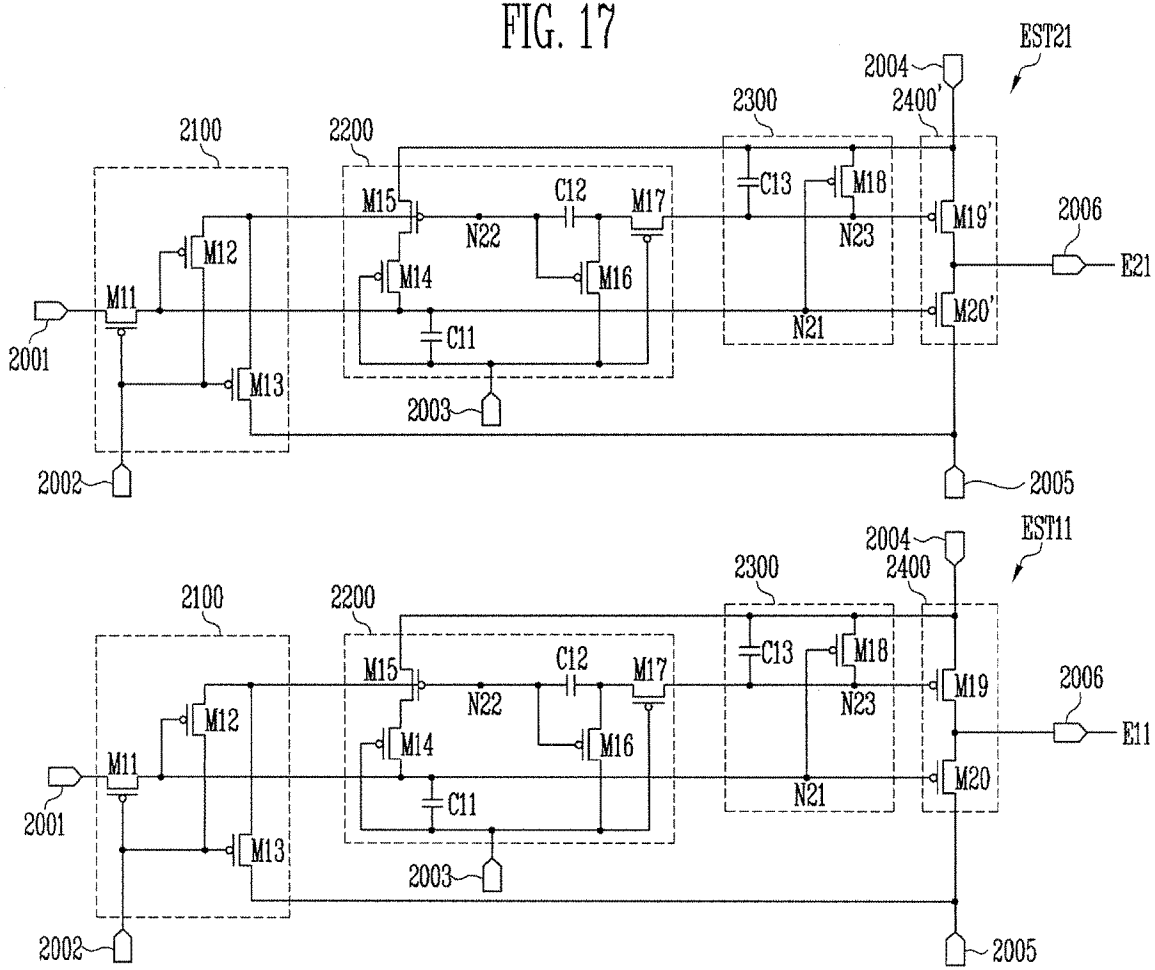
FIG. 17 illustrates another embodiment of a emission stage circuit of a first emission driver and a second emission driver.

FIG. 17 illustrates another embodiment of a emission stage circuit of a first emission driver and a second emission stage driver in FIG. 3. For the convenience of explanation, FIG. 17 illustrates the emission stage circuit EST11 of the first sub emission driver 311 and the emission stage circuit EST21 of the second emission driver 320. In addition, for the convenience of explanation, the emission stage circuit EST11 of the first sub emission driver 311 will be indicated as the first emission stage circuit EST11 and the emission stage circuit EST21 of the second emission driver 320 will be indicated as the second emission stage circuit EST21.

Since the area of the second pixel area AA2 is less than the first pixel area AA1, brightness deviation caused by the load difference may arise in the first pixel area AA1 and in the second pixel area AA2. In order to reduce the brightness deviation, the size of the at least one transistor in each scan stage circuit may be different in accordance with the load difference. For example, at least one transistor of the transistors M11 to M20' included in the second emission stage circuit EST21 may be smaller than the transistors M11 to M20 in the first emission stage circuit EST11.

This may be applied to the output unit 2400 and 2400' directly related to the output signal. For example, respective areas of the transistors M19' and M20' in the output unit 2400' of the second emission stage circuit EST21 may be smaller than the transistors M19 and M20 in output unit 2400 of the first emission stage circuit EST11.

To this end, the ratio (W/L) of the width to the length of the channel of each transistor may be controlled. For example, the ratio (W/L) of the width to the length of the channel of the transistors M19' and M20' in the second emission stage circuit EST21 may be less than ratio (W/L) of the width to the length of the channel of the transistors M19 and M20 in the first emission stage circuit EST11.

The first emission driver 310 and the second emission driver 320 are exemplified. The above may be applied to the first emission driver 310 and the third emission driver 330 in the same manner. Since respective sizes of the transistors included in the second emission driver 320 and third emission driver 330 are reduced, dead space at the upper corner of the display device may be reduced or minimized.

Figure 18:
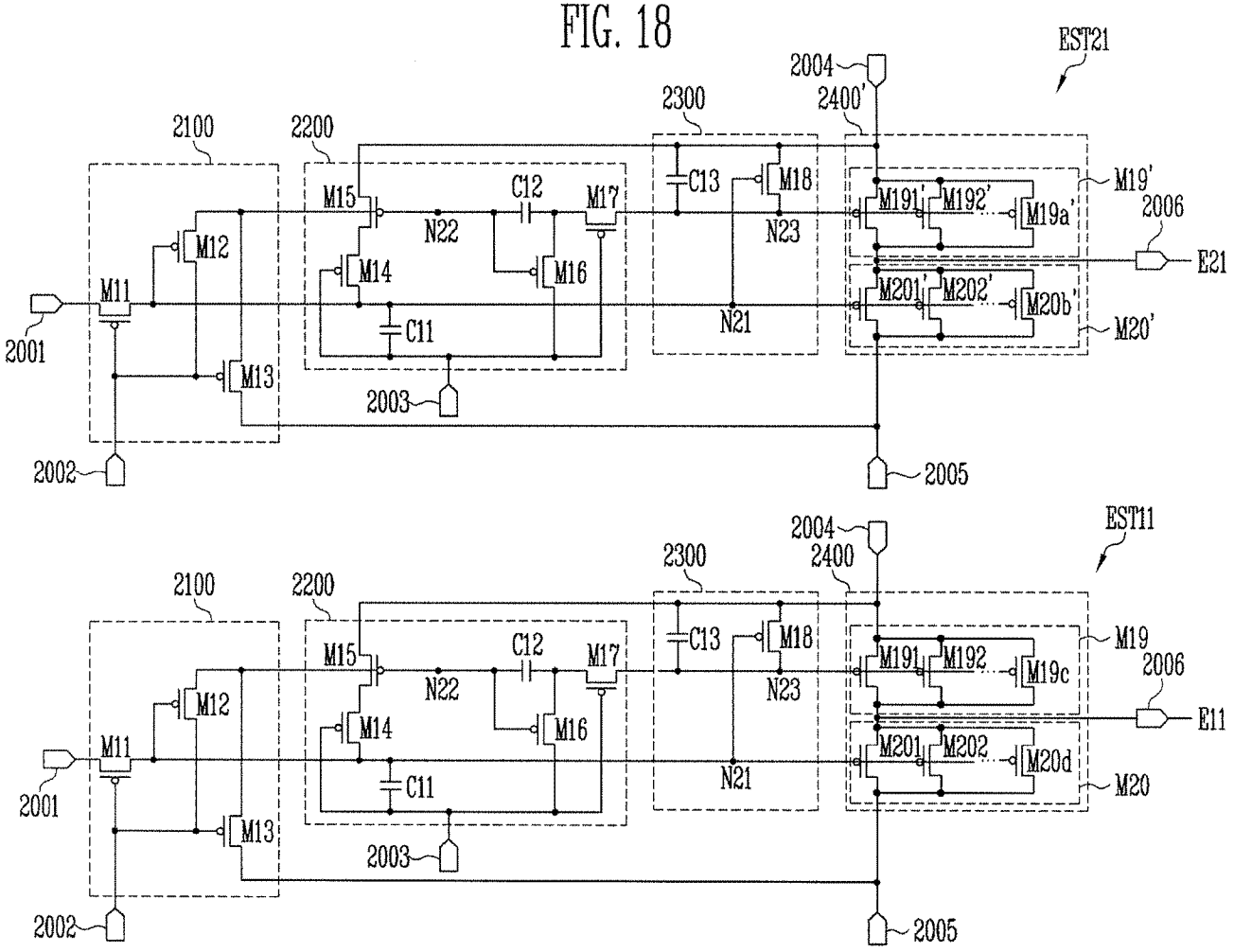
FIG. 18 illustrates anther embodiment of a emission stage circuit of a first emission driver and a second emission.

FIG. 18 illustrates another embodiment of a emission stage circuit of a first emission driver and a second emission stage driver in FIG. 3. For the convenience of explanation, FIG. 18 illustrates the emission stage circuit EST11 of the first sub emission driver 311 and the emission stage circuit EST21 of the second emission driver 320. In addition, for the convenience of explanation, the emission stage circuit EST11 of the first sub emission driver 311 will be indicated as the first emission stage circuit EST11 and the emission stage circuit EST21 of the second emission driver 320 will be indicated as the second emission stage circuit EST21.

Each of the transistors M19' and M20' in the output unit 2400' of the second emission stage circuit EST21 may include a plurality of auxiliary transistors connected in parallel. For example, a nineteenth transistor M19' of the second emission stage circuit EST21 may include first auxiliary transistors M191' to M19*a*' and a twentieth transistor M20' of the second emission stage circuit EST21 may include second auxiliary transistors M201' to M20*b*'.

Each of the transistors M19 and M20 included in the output unit 2400 of the first emission stage circuit EST11 may include a plurality of auxiliary transistors connected in parallel. For example, a nineteenth transistor M19 of the first emission stage circuit EST11 may include third auxiliary transistors M191 to M19*c* and a twentieth transistor M20 of the first emission stage circuit EST11 may include fourth auxiliary transistors M201 to M20*d*.

To control the size of each transistor M19', M20', M19 and M20, the number of auxiliary transistors in each of the transistors M19', M20', M19 and M20 may be differently determined. For example, the number of first auxiliary transistors M191' to M19*a*' may be less than the number of third auxiliary transistors M191 to M19*c*. The number of second auxiliary transistors M201' to M20*b*' may be less than the number of fourth auxiliary transistors M201 to M20*d*.

For example, ratios(W/L) of widths to lengths of channels of the first auxiliary transistors M191' to M19*a*' may be the same as one another, and ratios(W/L) of widths to lengths of channels of the second auxiliary transistors M201' to M20*b*' may be the same as one another. In addition, the ratios(W/L) of the widths to the lengths of the channels of the first auxiliary transistors M191' to M19*a*' may be the same as the ratios(W/L) of the widths to the lengths of the channels of the second auxiliary transistors M201' to M20*b*'.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The drivers, controllers, and other processing features described herein may be implemented in logic which, for example, may include hardware, software, or both. When implemented at least partially in hardware, the drivers, controllers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers, controllers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from embodiments set forth in the claims.

What is claimed is:

1. A display device, comprising:

a substrate including a first pixel area, a second pixel area, a third pixel area, and a space between the second and third pixel areas;

first pixels in the first pixel area connected to first scan lines for supplying a first scan signal to the first pixels in a first direction and a second direction opposite to the first direction and first emission control lines for supplying a first emission control signal to the first pixels in the first direction and the second direction;

second pixels in the second pixel area connected to second scan lines for supplying a second scan signal to the second pixels in the first direction and second emission control lines for supplying a second emission control signal to the second pixels in the second direction opposite to the first direction;

third pixels in the third pixel area connected to third scan lines for supplying a third scan signal to the third pixels in the second direction and third emission control lines for supplying a third emission control signal to the third pixels in the first direction, a first scan driver including a first scan stage circuit to supply the first scan signal to the first scan lines in the first and the second directions;

a second scan driver including a second scan stage to supply the second scan signal to the second scan lines in the first direction; and a third scan driver to supply the third scan signal to the third scan lines in the second direction, wherein:

the second scan lines are spaced apart from the third scan lines, and the second emission control lines are spaced apart from the third emission control lines, and wherein:

the first scan stage circuit includes:

a first transistor connected between a first input terminal and a first scan line;

a second transistor connected between the first scan line and a second input terminal, wherein the first and second transistors are connected in series between the first and second input terminals; and a first driving circuit to control the first transistor and the second transistor, and the second scan stage circuit includes:

a third transistor connected between a third input terminal and a second scan line;

a fourth transistor connected between the second scan line and a fourth input terminal, wherein the third and fourth transistors are connected in series between the third and fourth input terminals; and a second driving circuit to control the third transistor and the fourth transistor.

2. The display device as claimed in claim 1, wherein each of the second pixel area and the third pixel area is smaller than the first pixel area.

3. The display device as claimed in claim 1, wherein the second pixel area is spaced apart from the third pixel area by the space between the second and third pixel areas.

4. The display device as claimed in claim 1, wherein the substrate further includes a first peripheral area, a second peripheral area, and a third peripheral area outside the first pixel area, the second pixel area, and the third pixel area, and wherein the space of the substrate is between the second peripheral area and the third peripheral area.

5. The display device as claimed in claim 4, further comprising:

a first emission driver, in the first peripheral area, to supply the first emission control signal to the first emission control lines;

a second emission driver, in the second peripheral area, to supply the second emission control signal to the second emission control lines in the second direction; and a third emission driver, in the third peripheral area, to supply the third emission control signal to the third emission control lines in the first direction, and wherein the first scan driver is in the first peripheral area, the second scan driver is in the second peripheral area, and the third scan driver is in the third peripheral area.

6. The display device as claimed in claim 5, wherein:

the second scan driver and the second emission driver are at a first side of the second pixel area, and the third scan driver and the third emission driver are at a second side of the third pixel area.

7. The display device as claimed in claim 5, wherein:

the second scan driver is at a first side of the second pixel area, the second emission driver is at a second side of the second pixel area, the third scan driver is at a first side of the third pixel area, and the third emission driver is at a second side of the third pixel area, wherein the second side of the second pixel area faces the second side of the third pixel area.

8. The display device as claimed in claim 5, wherein the first scan driver includes:

a first sub scan driver connected to a first side of the first scan lines for supplying the first scan signal to the first pixels in the first direction; and a second sub scan driver connected to a second side of the first scan lines for supplying the first scan signal to the first pixels in the second direction.

9. The display device as claimed in claim 8, wherein the first sub scan driver and the second sub scan driver are to concurrently supply the first scan signal to the first scan lines.

10. The display device as claimed in claim 9, wherein:

the first sub scan driver including a plurality of scan stage circuits to supply the first scan signal to the first scan lines, and the second sub scan driver including a plurality of scan stage circuits to supply the first scan signal to the first scan lines.

11. The display device as claimed in claim 5, wherein the first scan driver includes:

a first sub scan driver at a first side of the first pixel area; and a second sub scan driver at a second side of the first pixel area.

12. The display device as claimed in claim 11, wherein:

the first sub scan driver is to supply the first scan signal to a first portion of the first scan lines, and the second sub scan driver is to supply the first scan signal to a second portion of the first scan lines.

13. The display device as claimed in claim 12, wherein:

the first sub scan driver includes a plurality of scan stage circuits to supply the first scan signal to the first portion of the first scan lines, and the second sub scan driver includes a plurality of scan stage circuits to supply the first scan signal to the second portion of the first scan lines.

14. The display device as claimed in claim 13, wherein:

the scan stage circuits of the first sub scan driver are to supply the first scan signal to an odd-number-th first scan lines, and the scan stage circuits of the second sub scan driver are to supply the first scan signal to an even-number-th first scan lines.

15. The display device as claimed in claim 5, wherein the first emission driver includes:

a first sub emission driver connected to a first side of the first emission control lines for supplying the first emission control signal to the first pixels in the first direction; and a second sub emission driver connected to a second side of the first emission control lines for supplying the first emission control signal to the first pixels in the second direction.

16. The display device as claimed in claim 15, wherein the first sub emission driver and the second sub emission driver are to concurrently supply the first emission control signal for the first emission control lines.

17. The display device as claimed in claim 16, wherein:

the first sub emission driver is connected to a first side of the first emission control lines, the first sub emission driver including a plurality of emission stage circuits to supply the first emission control signal to the first emission control lines, and the second sub emission driver is connected to a second side of the first emission control lines, the second sub emission driver including a plurality of emission stage circuits to supply the first emission control signal to the first emission control lines.

18. The display device as claimed in claim 5, wherein the first emission driver includes:

a first sub emission driver at a first side of the first pixel area; and a second sub emission driver at a second side of the first pixel area.

19. The display device as claimed in claim 18, wherein:

the first sub emission driver is to supply the first emission control signal to a first portion of the first emission control lines, and the second sub emission driver is to supply the first emission control signal to a second portion of the first emission control lines.

20. The display device as claimed in claim 19, wherein:

the first sub emission driver includes a plurality of emission stage circuits to supply the first emission control signal to the first portion of the first emission control lines, and the second sub emission driver include a plurality of emission stage circuits to supply the first emission control signal to the second portion of the first emission control lines.

21. The display device as claimed in claim 20, wherein:

the emission stage circuits of the first sub emission driver to supply the first emission control signal to an odd-number-th first emission control lines, and the emission stage circuits of the second sub emission driver to supply the first emission control signal to an even-number-th first emission control lines.

22. The display device as claimed in claim 5, wherein:

the second scan driver includes:

a third sub scan driver at a first side of the second pixel area to supply the second scan signal to a first portion of the second scan lines; and a fourth sub scan driver arranged at a second side of the second pixel area to supply the second scan signal to a second portion of the second scan lines, and the second emission driver includes:

a third sub emission driver at the second side of the second pixel area to supply the second emission control signal to a first portion of the second emission control lines; and a fourth sub emission driver at the first side of the second pixel area to supply the second emission control signal to a second portion of the second emission control lines.

23. The display device as claimed in claim 5, wherein:

the third scan driver includes:

a fifth sub scan driver at a first side of the third pixel area to supply the third scan signal to a first portion of the third scan lines; and a sixth sub scan driver at a second side of the third pixel area to supply the third scan signal to a second portion of the third scan lines, and the third emission driver includes:

a fifth sub emission driver arranged at the first side of the third pixel area to supply the third emission control signal to a first portion of the third emission control lines; and a sixth sub emission driver at the second side of the third pixel area to supply the third emission control signal to a second portion of the third emission control lines.

24. The display device as claimed in claim 1, wherein sizes of output transistors in the second scan stage circuit are smaller than sizes of output transistors in the first scan stage circuit.

25. The display device as claimed in claim 1, wherein a ratio of a width to a length of a channel of the third transistor is less than a ratio of a width to a length of a channel of the first transistor.

26. The display device as claimed in claim 1, wherein a ratio of a width to a length of a channel of the fourth transistor is less than a ratio of a width to a length of a channel of the second transistor.

27. The display device as claimed in claim 1, wherein:

the second transistor includes a plurality of first auxiliary transistors connected in parallel, and the fourth transistor includes a plurality of second auxiliary transistors connected in parallel.

28. The display device as claimed in claim 27, wherein a number of second auxiliary transistors is less than a number of first auxiliary transistors.

29. The display device as claimed in claim 1, wherein the second pixel area, the space of the substrate, and the third pixel area are sequentially arranged in the first direction.

30. The display device as claimed in claim 1, wherein the second pixel area, the space of the substrate, and the third pixel area are sequentially arranged in the second direction.

31. A display device, comprising:

a substrate including a first pixel area, a second pixel area and a third pixel area extending along a first direction from the first pixel area, and a concave formed between the second pixel area and the third pixel area;

first pixels, second pixels, and third pixels arranged in the first pixel area, the second pixel area, and the third pixel area, respectively; and a first driver, a second driver, and a third driver to drive the first pixels, the second pixels, and the third pixels, respectively, wherein at least one transistor included in the first driver has a different characteristic from at least one transistor included in the second driver, wherein the first driver includes a first scan driver supplying first scan signals to the first pixels in a second direction perpendicular to the first direction and a third direction opposite to the second direction and including a first scan stage circuit, the second driver includes a second scan driver supplying second scan signals to the second pixels in the second direction and including a second scan stage circuit, and the third driver includes a third scan driver supplying third scan signals to the third pixels in the third direction, and wherein:

the first driver further includes a first emission driver to supply emission control signals to the first pixels in a second direction and a third direction opposite to the second direction, the second driver further includes a second emission driver to supply second emission control signals to the second pixels in the third direction from the concave to the second pixel area, and the third driver further includes a third emission driver to supply third emission control signals to the third pixels in the second direction from the concave to the third pixel area, and wherein:

the first scan stage circuit includes:

a first transistor connected between a first input terminal and a first scan line;

a second transistor connected between the first scan line and a second input terminal, wherein the first and second transistors are connected in series between the first and second input terminals; and a first driving circuit to control the first transistor and the second transistor, and the second scan stage circuit includes:

a third transistor connected between a third input terminal and a second scan line;

a fourth transistor connected between the second scan line and a fourth input terminal, wherein the third and fourth transistors are connected in series between the third and fourth input terminals; and a second driving circuit to control the third transistor and the fourth transistor.

32. The display device as claimed in claim 31, wherein the at least one transistor included in the second driver has a same characteristic as at least one transistor included in the third driver.

33. The display device as claimed in claim 31, wherein a ratio of a width to a length of a channel of the at least one transistor included in the first driver is greater than a ratio of a width to a length of a channel of the at least one transistor included in the second driver.

34. The display device as claimed in claim 31, wherein the at least one transistor included in the first driver includes a plurality of first auxiliary transistors connected in parallel with one another, the at least one transistor included in the second driver includes a plurality of second auxiliary transistors connected in parallel with one another, and a number of second auxiliary transistors is less than a number of first auxiliary transistors.

* * * * *